US007896668B2

(12) United States Patent
Yash et al.

(10) Patent No.: US 7,896,668 B2
(45) Date of Patent: Mar. 1, 2011

(54) ELECTRICAL CONNECTOR ASSEMBLY WITH A DETACHABLE WIRE ROUTING COVER

(75) Inventors: Michael Yash, Milford, MI (US); Vincent Ng Vern Shen, Singapore (SG); Tommy Tan Chin Yaw, Singapore (SG)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/433,446

(22) Filed: Apr. 30, 2009

(65) Prior Publication Data

US 2010/0279529 A1 Nov. 4, 2010

(51) Int. Cl.
*H01R 13/62* (2006.01)

(52) U.S. Cl. ..... 439/153

(58) Field of Classification Search ..... 439/153, 439/676, 540.1, 466, 468
See application file for complete search history.

(56) References Cited

U.S. PATENT DOCUMENTS 4,575,174 A 3/1986 Leeds et al.
5,234,358 A 8/1993 Polgar
5,788,528 A 8/1998 Orr, Jr. et al.
5,897,392 A 4/1999 Takahashi et al.
5,910,026 A 6/1999 Geib et al.
5,971,796 A 10/1999 Duhr
6,095,852 A * 8/2000 Gregory, II ..... 439/540.1
6,394,844 B1 * 5/2002 Frias Valero et al. ..... 439/607.7
7,182,626 B2 * 2/2007 Langolf ..... 439/473

* cited by examiner

*Primary Examiner*—Jean F Duverne
(74) *Attorney, Agent, or Firm*—Rader, Fishman & Grauer PLLC

(57) ABSTRACT

An electrical connector assembly includes a housing body and a wire routing cover. The housing body having a box-shaped configuration has a plurality of terminal-receiving holes formed therethrough, a pair of rail-receiving channels formed into opposing side walls and at least one latch projection. The wire routing cover includes a base panel with a pair of rail members and at least one latch element attached to the base panel. The base panel has a plurality of wire routing holes formed therethrough. Upon releasably connecting the housing body and the wire routing cover together, respective ones of the pair of rail-receiving channels slidably receive at least a portion of the respective ones of the pair of rail members, the at least one latch projection is releasably captured by the at least one latch element and the plurality of terminal-receiving holes and the plurality of wire routing holes register with one another.

35 Claims, 18 Drawing Sheets

ELECTRICAL CONNECTOR ASSEMBLY WITH A DETACHABLE WIRE ROUTING COVER

FIELD OF THE INVENTION

The present invention relates to an electrical connector assembly. More particularly, the present invention is directed to an electrical connector assembly with a detachable wire routing cover.

BACKGROUND OF THE INVENTION

Many different types of electrical connectors are known in the art. Some types of electrical connectors receive and retain a plurality of individual wires that are provided to the electrical connector in a bundle.

U.S. Pat. No. 5,897,392 to Takahashi et al. discloses a wire retaining clip for use with an electrical connector. The wire retaining clip guides bundled wires extending from an electrical connector mounted to a power distribution box and secures the wires to the box to prevent vibration of the wires thereby preventing separation of the wires from their terminals. The wire retaining clip is molded in a single piece and comprises a connector cover which snaps into attachment with the electrical connector to secure the wire terminals therein and a wire guide member attached to the cover by a living hinge. The wire guide member encloses the wires and routes them around an edge of the power distribution box and along a second surface of the box. The wires are taped or otherwise secured to the wire guide member and a lock mechanism on the wire guide member engages cooperating means on the power distribution box to secure the wires to the box.

U.S. Pat. No. 5,971,796 to Duhr teaches a wire harness and a connector shroud. The shroud secures a wire harness and its attached connector to an electrical power distribution center assembly. The shroud surrounds the end of the wire harness and engages the wire harness connector so as to permit a degree of linear movement of the connector relative to the shroud. The shroud is secured to a power distribution center housing to place the connector in alignment with a mating connector on the power distribution center and a bolt passing through the mating connector is tightened into engagement with a nut molded into the wire harness connector to draw the wire harness connector into electrical connection with the mating connector.

U.S. Pat. No. 5,910,026 to Gieb et al. reveals an electrical connector with a cable strain relief. An electrical connector assembly terminates the conductors of an electrical cable. A dielectric housing includes a plurality of terminal-receiving passages for receiving a plurality of terminals terminated to the conductors of the cable. A discrete dielectric cover is removably mounted on the housing over a termination end thereof. A discrete dielectric strain relief member is mounted on the housing near the termination end thereof and to which the electrical cable can be fixed. The cover is mounted to the housing independently of the strain relief member whereby the cover can be removed from the housing without removing the strain relief member and the affixed cable. The strain relief member can be mounted on the housing at a plurality of different locations whereby the cable can exit the connector from the housing in different locations and orientations.

SUMMARY OF THE INVENTION

An electrical connector assembly of the present invention includes a housing body and a wire routing cover. The housing body has a generally box-shaped configuration with a front surface, a rear surface disposed opposite the front surface, a pair of opposing side surfaces connected to and between the front and rear surfaces, an upper surface and a lower surface disposed opposite the upper surface and connected to and between the front and rear surfaces and to and between the pair of side surfaces. The housing body has a plurality of terminal-receiving holes formed through the housing body to and between the front surface and the rear surface, a pair of rail-receiving channels with a respective one of the pair of rail-receiving channels formed into a respective one of the pair of side surfaces and at least one latch projection connected to and projecting from at least one of the pair of side surfaces and the lower surface.

The wire routing cover includes a base panel, a pair of rail members and at least one latch element. The base panel has a front base panel surface and an opposing rear base panel surface with a plurality of wire routing holes formed through the base panel between the front and rear base panel surfaces and has a pair of base panel side walls, a base panel upper wall and a base panel lower wall with the pair of base panel side walls interconnecting the base panel upper wall and the base panel lower wall to form a generally rectangular configuration surrounding the plurality of wire routing holes. The pair of rail members extend parallel to one another. Respective ones of the pair of rail members are connected to respective ones of the pair of base panel side walls adjacent the base panel upper wall and extend perpendicularly therefrom in a rearwardly direction. The at least one latch element is connected to the base panel and extends perpendicularly therefrom in a cantilevered manner and in the rearwardly direction.

Upon releasably connecting the housing body and the wire routing cover together, respective ones of the pair of rail-receiving channels slidably receive at least a portion of the respective ones of the pair of rail members and the at least one latch projection is releasably captured by the at least one latch element.

The objects and advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
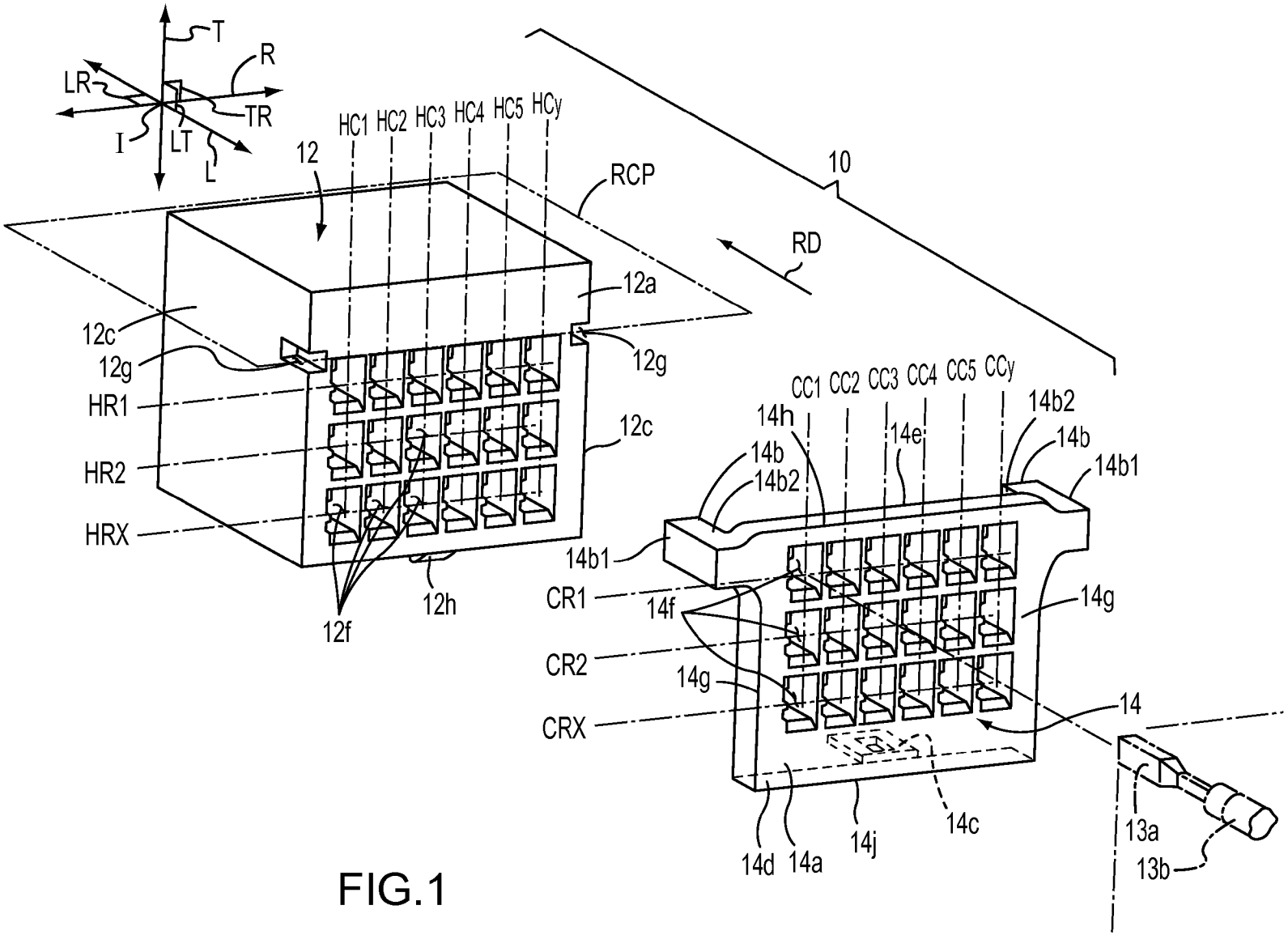
FIG. 1 is an exploded perspective view of a first exemplary embodiment of an electrical connector assembly of the present invention that includes an electrical connector housing and a wire routing cover disconnected from one another.

Hereinafter, embodiments of the present invention will be described with reference to the attached drawings. The structural components common to those of the prior art and the structural components common to respective embodiments of the present invention will be represented by the same symbols and repeated description thereof will be omitted. Further, the description of the exemplary embodiments employs descriptive terms such as "lower", "upper", "forward", "rearward" and the like to be used relative to the drawing figures for ease in understanding the invention. One of ordinary skill in the art may substitute non-descriptive terms in lieu thereof such as "first", "second" and the like and therefore the use of the descriptive terms herein shall not be construed to limit or narrow the scope of the invention.

Figure 2:
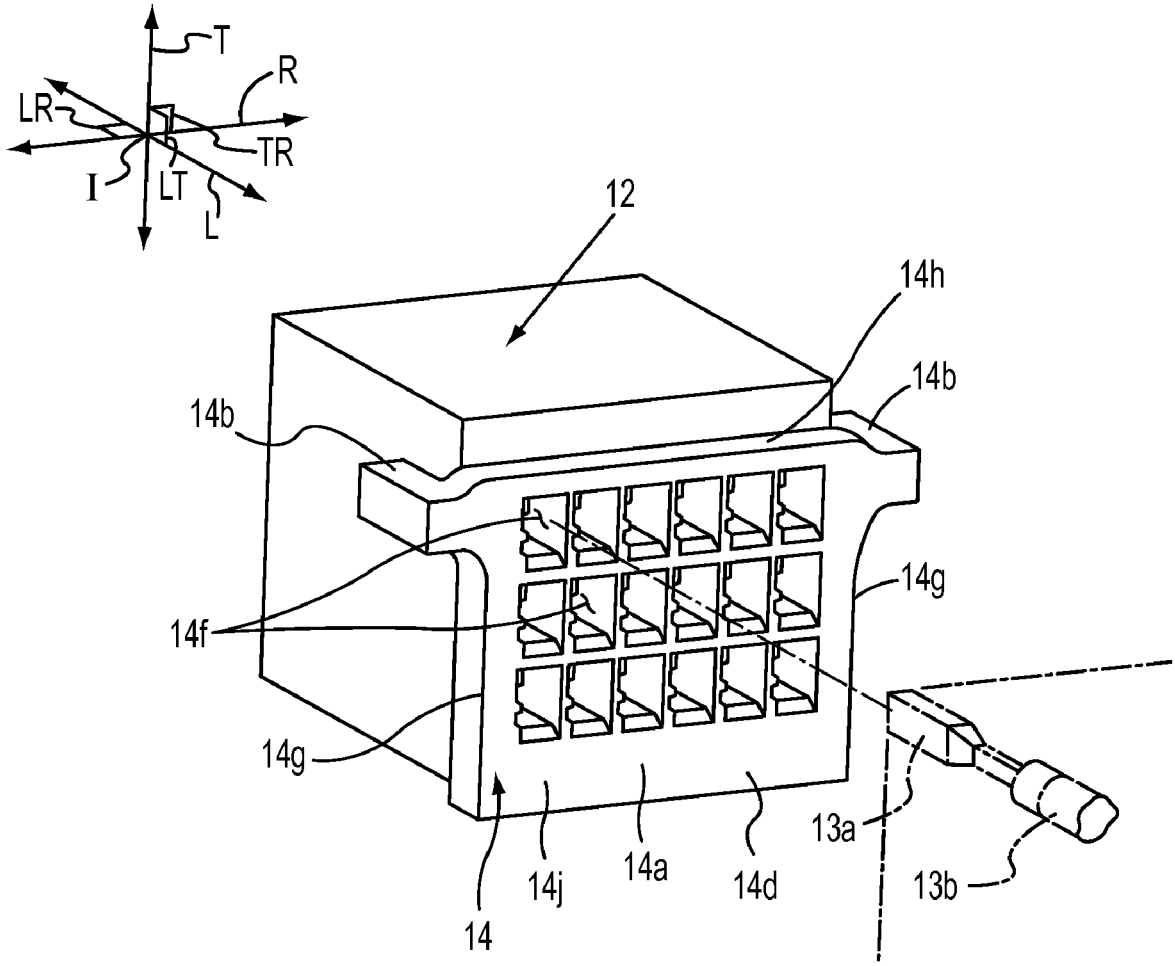
FIG. 2 is perspective view of the first exemplary embodiment of the electrical connector assembly of the present invention that includes the electrical connector housing and the wire routing cover releasably connected to one another.
Figure 3:
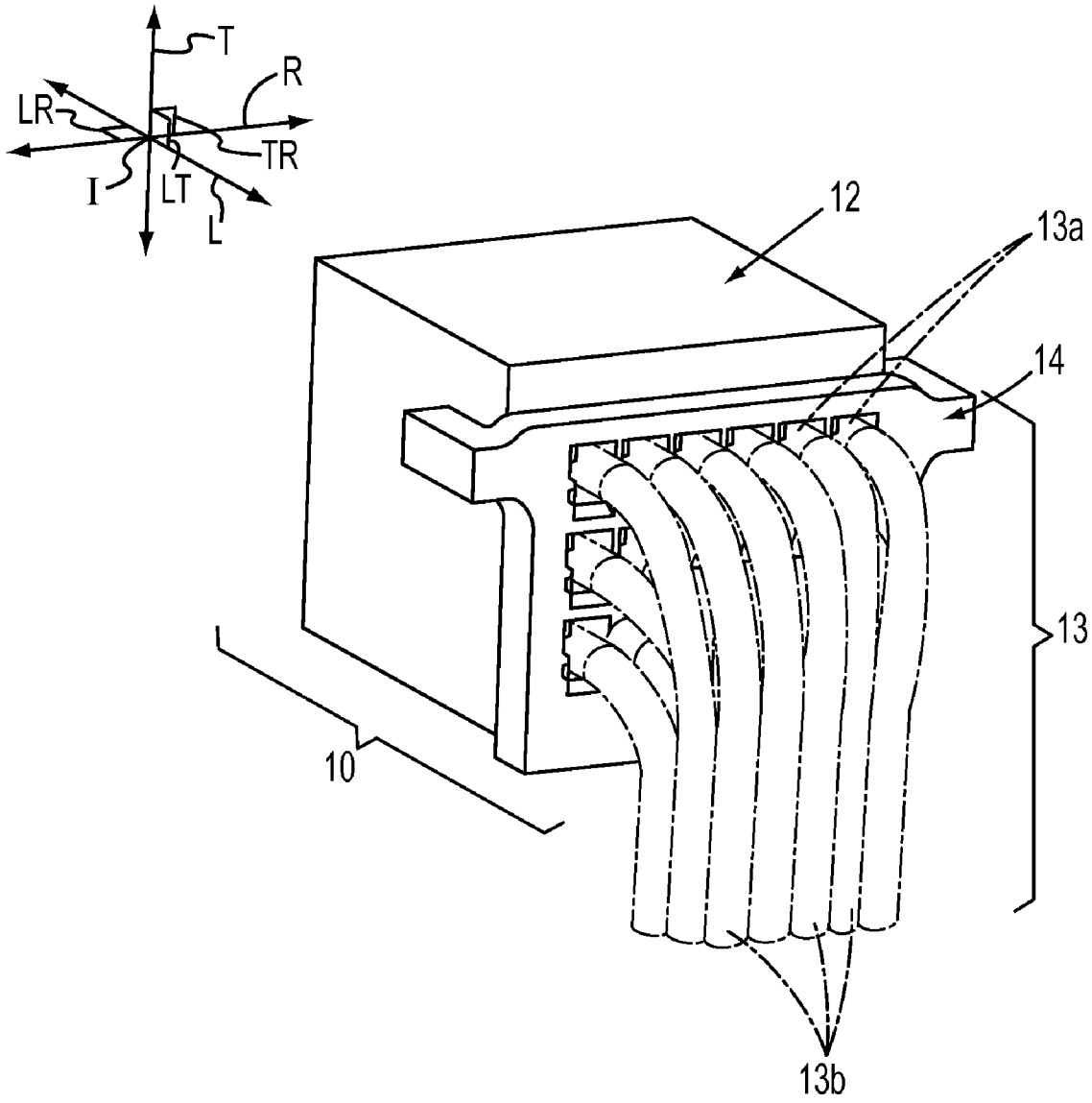
FIG. 3 is perspective view of the first exemplary embodiment of the electrical connector assembly of the present invention that includes the electrical connector housing and the wire routing cover releasably connected to one another with a wire structure connected thereto.

A first exemplary embodiment of an electrical connector assembly 10 of the present invention is hereinafter described with reference to FIGS. 1-11. As best shown in FIGS. 1-3, the electrical connector assembly 10 includes an electrical connector housing 12 and a wire routing cover 14. As discussed in more detail below, the electrical connector assembly is adapted for use with an assemblage of wire structures 13 as shown in FIG. 3. As best shown in FIGS. 1 and 2, each wire structure 13 includes a terminal 13*a* and a wire 13*b* electrically connected to the terminal 13*a*. The electrical connector housing 12 extends along and about a longitudinal axis L, a lateral axis R and a transverse axis T that perpendicularly intersect one another at a common intersection point I. The longitudinal axis L and the lateral axis R define a longitudinal/lateral plane LR, while the longitudinal axis L and the transverse axis T define a longitudinal/transverse plane LT and the lateral axis R and the transverse axis T define a lateral/transverse plane TR.

As shown in FIGS. 1 and 5-7, the electrical connector housing 12 is a housing body (and is therefore also referred to as housing body 12). The housing body 12 has a generally box-shaped configuration and has a front surface 12*a*, a rear surface 12*b* disposed opposite the front surface 12*a*, a pair of opposing side surfaces 12*c* that are connected to and between the front surface 12*a* and the rear surface 12*b*, an upper surface 12*d* and a lower surface 12*e*. The lower surface 12*e* is disposed opposite the upper surface 12*d*. The lower surface 12*e* and the upper surface 12*d* are connected to and between the front and rear surfaces 12*a* and 12*b* respectively and to and between the pair of side surfaces 12*c*. Further, the housing body 12 has a plurality of terminal-receiving holes 12*f*. The plurality of terminal-receiving holes 12 extend to and between the front surface 12*a* and the rear surface 12*b*.

Figure 5:
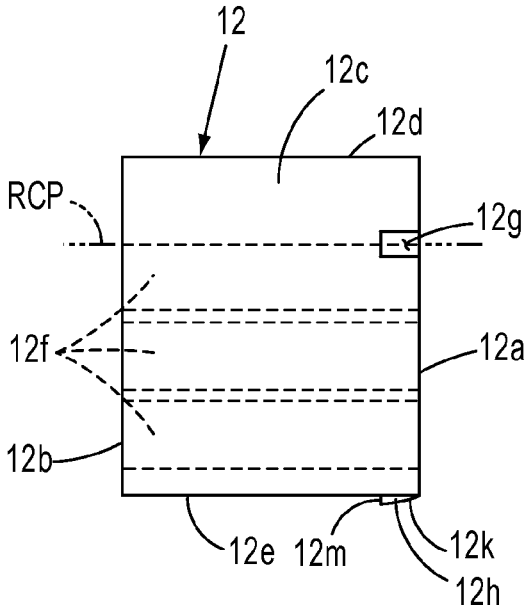
FIG. 5 is a side elevational view of the electrical connector housing of the first exemplary embodiment of the electrical connector assembly of the present invention.
Figure 6:
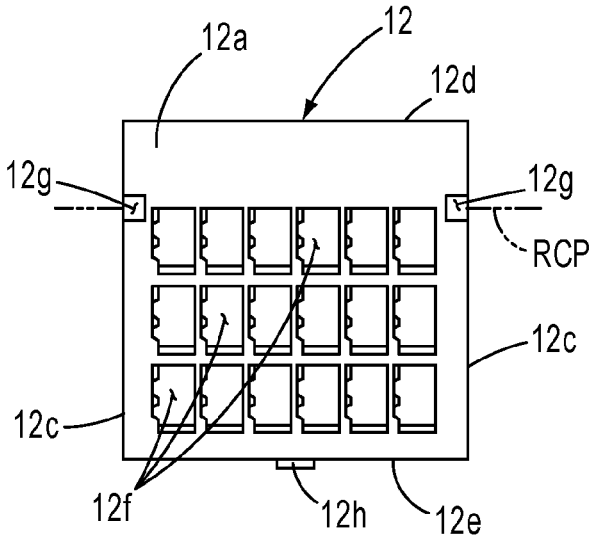
FIG. 6 is a front elevational view of the electrical connector housing of the first exemplary embodiment of the electrical connector assembly of the present invention.

Also, as shown in FIGS. 1, 5 and 6, the housing body 12 also includes a pair of rail-receiving channels 12*g*. A respective one of the pair of rail-receiving channels 12*g* is formed into a respective one of the pair of side surfaces 12*c*. Each one of the pair of rail-receiving channels commences from the front surface 12*a* and extends rectilinearly towards the rear surface 12*b*. Furthermore, the pair of rail-receiving channels 12*g* extend parallel to one another and are disposed in a common rail channel plane RCP that, in turn, extends parallel to the upper surface 12*a* and the lower surface 12*b*.

Figure 7:
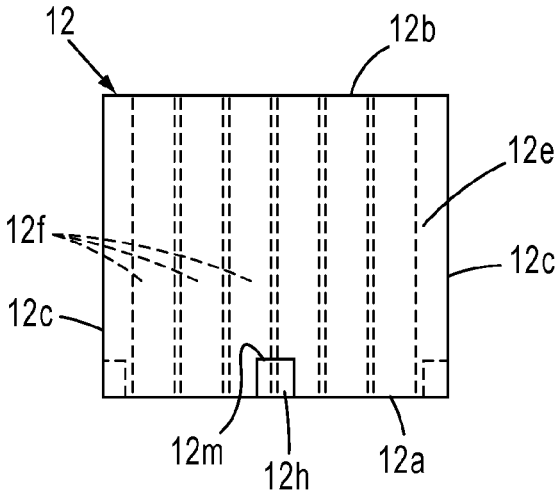
FIG. 7 is a bottom plan view of the electrical connector housing of the first exemplary embodiment of the electrical connector assembly of the present invention.

Additionally, in FIGS. 1, 5 and 6, the housing body 12 also includes a latch projection 12*h*, which is more specifically referred to hereinafter as a lower surface latch projection 12*h* since the latch projection 12*h* is connected to and projects from the lower surface 12*e*. The lower surface latch projection 12*h* commences at the front surface 12*a* and extends towards the rear surface 12*b*. As best shown in FIG. 5, the lower surface latch projection 12*h* is configured, in cross-section, as a right triangle. Note in FIG. 5 that the lower surface latch projection 12*h* forms a lower latch ramping surface 12*k* that commencing at the front surface 12*a* and projects away from the lower surface 12*e* as the lower latch ramping surface 12*k* extends towards the rear surface 12*b*. In FIGS. 5 and 7, the lower surface latch projection 12*h* terminates in a flat ramp surface 12*m* that extends perpendicularly from the lower surface 12*e*.

As illustrated in FIGS. 1 and 6, the plurality of terminal-receiving holes 12*f* form a matrix of terminal-receiving holes 12*f* that are arranged in a plurality of rows HR1 . . . HRx and in a plurality of columns HC1 . . . HCy. A skilled artisan would appreciate that "x" and "y" can be any integer above 1 and would comprehend that, for the first exemplary embodiment of the invention, "x" is 3, for three rows, and "y" is 6 for six columns. Although not by way of limitation but by example only, each one of the plurality of rows HR1 . . . HRx extend parallel to one another and each one of the plurality of columns HC1 . . . HCy of the matrix of terminal-receiving holes 12*f* extend parallel to one another.

With reference to FIGS. 1, 2, 4 and 8-10, the wire routing cover 14 includes a base panel 14*a*, a pair of rail members 14*b* and a latch element 14*c*. The base panel 14*a* has a front base panel surface 14*d* and an opposing rear base panel surface 14*e*. A plurality of wire routing holes 14*f* are formed through the base panel 14*a* between the front base panel surface 14*d* and the rear base panel surface 14*e*. Also, the base pane 14*a* has a pair of base panel side walls 14*g*, a base panel upper wall 14*h* and a base panel lower wall 14*j*. The pair of base panel side walls 14*g* interconnect the base panel upper wall 14*h* and the base panel lower wall 14*j*. The front base panel surface 14*d*, the rear base panel surface 14*e*, the pair of base panel side walls 14*g*, the base panel upper wall 14*h* and the base panel lower wall 14*j* form a generally rectangular configuration surrounding the plurality of wire routing holes 14*f*.

As best shown in FIGS. 1 and 2, wire routing cover forms a matrix of wire routing holes 14*f* that arranged in a plurality of rows CR1 . . . CRx where x can be any integer above 1 and in a plurality of columns CC1 . . . CCy. A skilled artisan would appreciate that "x" and "y" can be any integer above 1 and would comprehend that, for the first exemplary embodiment of the invention, "x" is 3, for three rows, and "y" is 6 for six columns.

In FIGS. 1, 2, 4 and 8-10, the pair of rail members 14*b* extend parallel to one another. Respective ones of the pair of rail members 14*b* are connected to respective ones of the pair of base panel side walls 14*g* adjacent the base panel upper wall 14*h* and extend perpendicularly therefrom in a rearwardly direction as depicted by arrow RD in FIG. 1. Further, the latch element 14*c* is connected to the base panel 14*a* and extends perpendicularly therefrom in a cantilevered manner (FIGS. 1, 8 and 10) and in the rearwardly direction RD.

Figure 10:
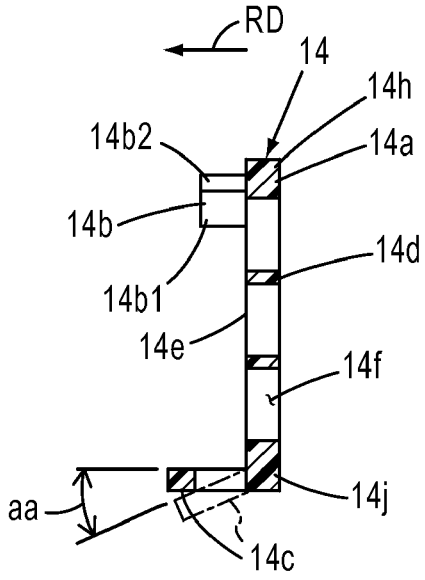
FIG. 10 is a cross-section view of the wire routing cover of the first exemplary embodiment of the electrical connector assembly of the present invention taken along line 10-10 in FIG. 9.

The latch element 14*c* is referred to hereinafter as a lower base panel latch element 14*c* since it is connected to the base panel lower wall 14*j*. Note that, although not by way of limitation but by example only, the base panel latch element 14*c* is disposed centrally of the base panel lower wall 14*j* between the pair of base panel side walls 14*g*. As best shown in FIG. 2, the lower base panel latch element 14*c* has a lower base panel latch hole 14*k* that is formed therethrough. As is known in the art, the lower base panel latch element 14*c* is operative to angularly move at an angle aa as illustrated in FIG. 10 to an between a normal state (solid line in FIGS. 4 and 10) and a flexed state (dashed line in FIGS. 4 and 10). The lower base panel latch element 14*c* is biased to the normal state.

Figure 4:
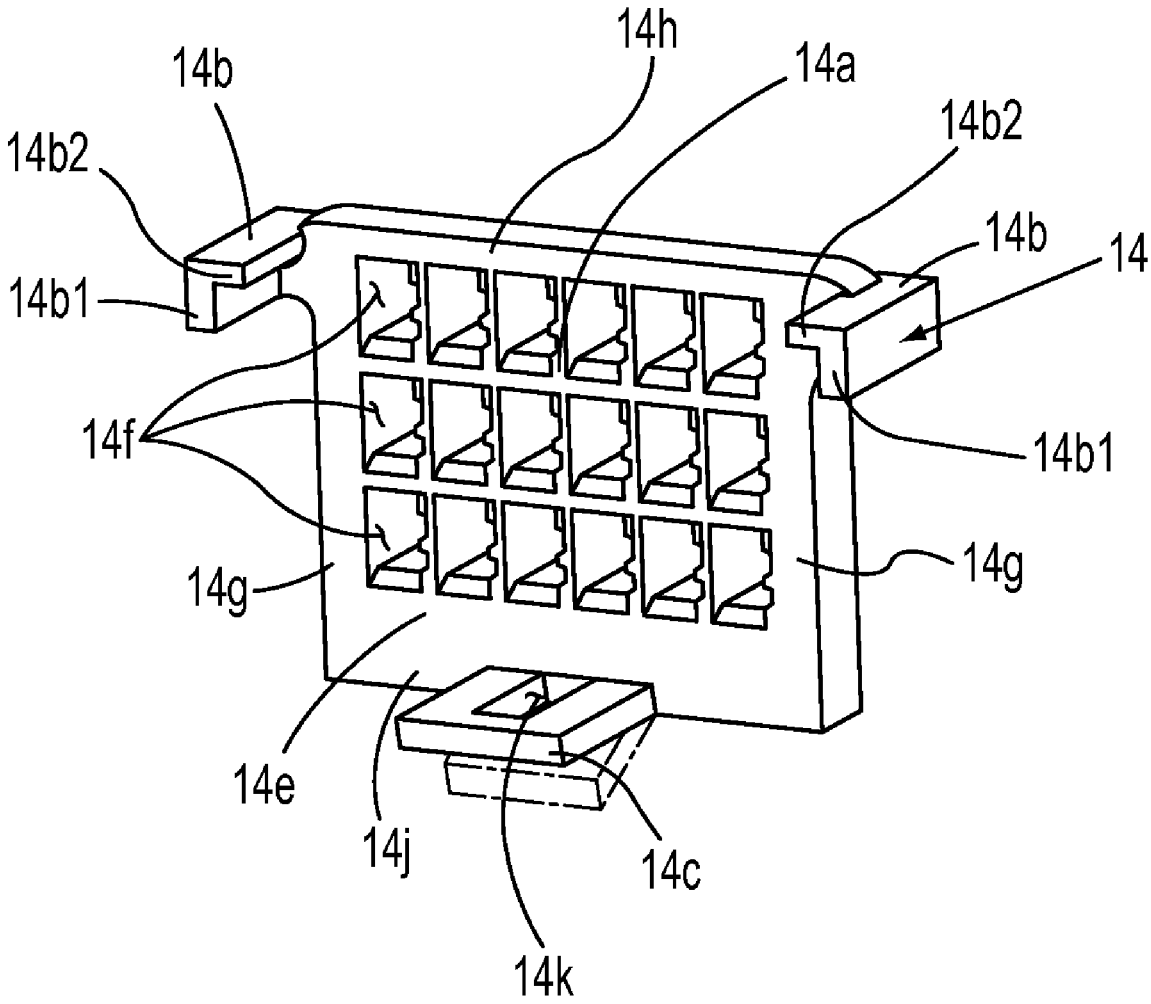
FIG. 4 is a rear perspective view of the wire routing cover of the first exemplary embodiment of the electrical connector assembly of the present invention
Figure 8:
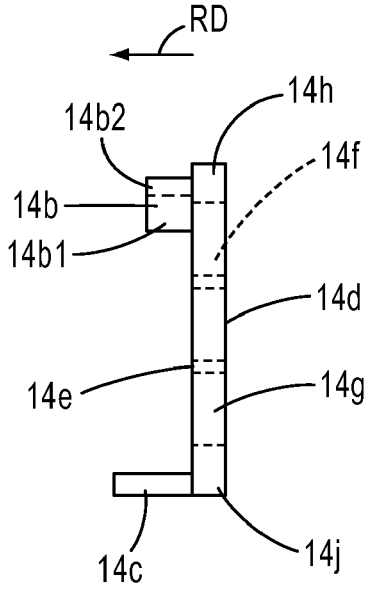
FIG. 8 is a side elevational view of the wire routing cover of the first exemplary embodiment of the electrical connector assembly of the present invention.
Figure 9:
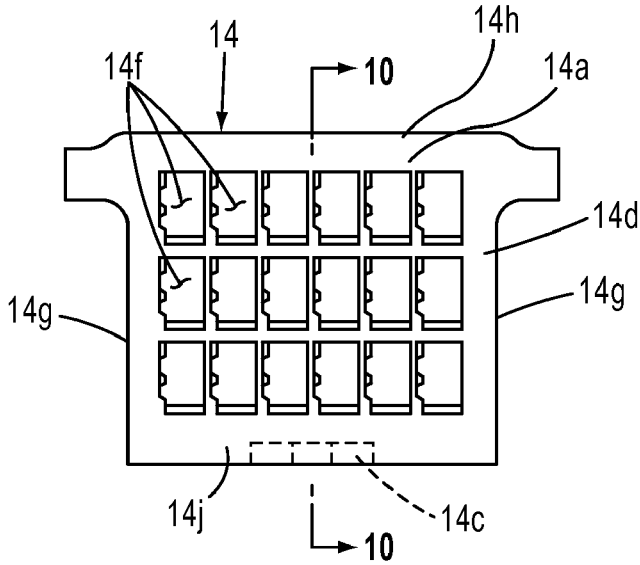
FIG. 9 is a front elevational view of the wire routing cover of the first exemplary embodiment of the electrical connector assembly of the present invention.
Figure 11:
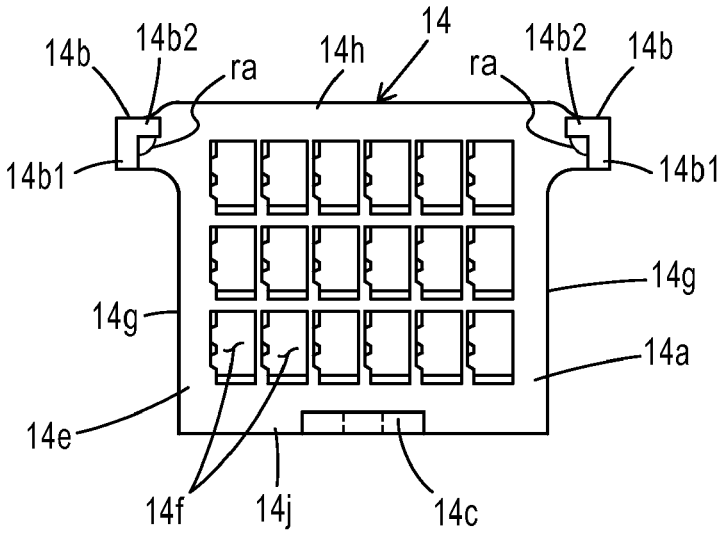
FIG. 11 is a rear elevational view of the wire routing cover of the first exemplary embodiment of the electrical connector assembly of the present invention.

As shown in FIGS. 1, 4, 8, 10 and 11, each one of the pair of rail members 14*b* includes a side rail wall 14*b*1 and a rail 14*b*2 and the rail 14*b*2 is integrally formed with the side rail wall 14*b*1 to form a right angle ra. As best shown in FIGS. 4, 8 and 10, respective ones of the side rail walls 14*b*1 extend adjacent the base panel upper wall 14*h* toward the base panel lower wall 14*j*. Also, respective ones of the rails 14*b*2 extend from a respective base panel side wall 14*g* towards a respective other base panel side wall 14*g*. As best shown in FIG. 11, by way of example only, the base panel side walls 14*g* are disposed between respective ones of the side rail walls 14*b*1. As best shown in FIGS. 8 and 10, respective ones of the rails 14*b*2 are integrally connected to the rear base panel surface 14*e*.

Upon connecting the housing body 12 and the wire routing cover 14 together as shown in sequence from FIG. 1 to FIG. 2, respective ones of the pair of rail-receiving channels 12*g* are aligned to slidably receive respective ones of the pair of rails 14*b*2 and the lower surface latch projection 12*h* is aligned to releasably capture the lower base panel latch element 14*c*. It is understood by a skilled artisan that the lower base panel latch hole 14*k* is sized to releasably capture the lower surface latch projection 12*h*. Further, when the housing body 12 and the wire routing cover 14 are releasably connected together, respective ones of the terminal receiving holes 12*f* and the wire routing holes 14*f* are aligned to register with one another.

A second embodiment of an electrical connector assembly 210 of the present invention is introduced in FIGS. 12-23. The second embodiment of the electrical connector assembly 210 is similar to the first exemplary embodiment of the electrical connector assembly 10 discussed above. The distinguishing features between the two embodiments are hereinafter discussed below.

The electrical connector assembly 210 includes an electrical connector housing 212 (also, referred to as housing body 212) and a wire routing cover 214. As shown in FIGS. 12, 13 and 15-17, the electrical connector housing 212 includes the lower surface latch projection 12*h* and a pair of side latch projections 212*n*. A respective one of the pair of side latch projections 212*n* project from a respective one of the pair of side surfaces 12*c*. Each one of the pair of side latch projections 212*n* commences at the front surface 12*a* and extends towards the rear surface 12*b*, i.e. in the rearwardly direction RD. Each one of the pair of side latch projections 212*n* is configured, as viewed in side elevation in FIG. 15, as a right triangle. In FIG. 17, each side latch projection 212*n* forms a side latch ramping surface 212*n*1 that commences at the front surface 12*a* and projects away from the respective side surface 12*c* as the side latch ramping surface 212*n*1 extends towards the back surface 12*b*. By example only, respective ones of side latch back surfaces 212*n*2 extend perpendicularly from respective side surfaces 12*c*.

Figure 12:
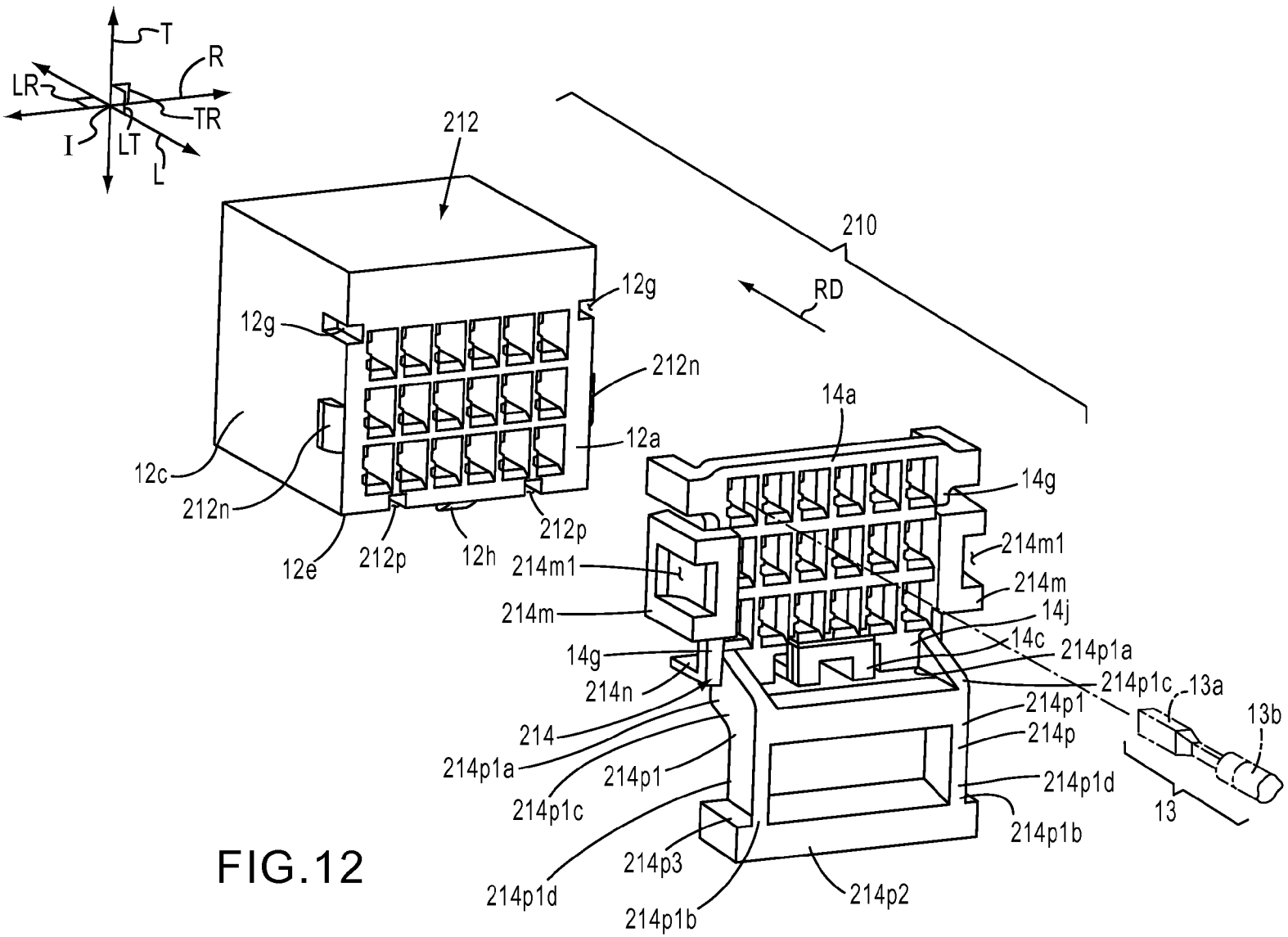
FIG. 12 is an exploded perspective view of a second exemplary embodiment of a electrical connector assembly of the present invention that includes an electrical connector housing and a wire routing cover disconnected from one another.
Figure 15:
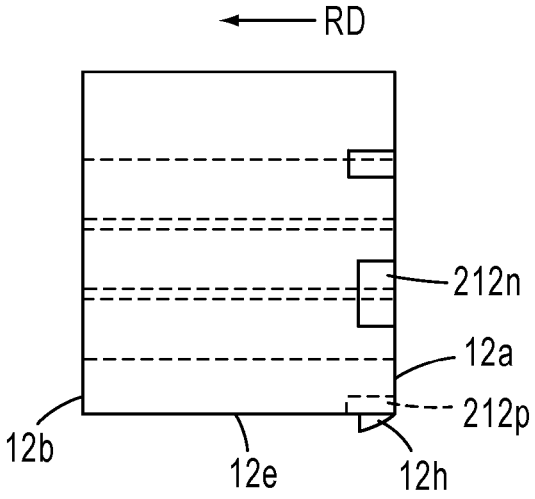
FIG. 15 is a side elevational view of the electrical connector housing of the second exemplary embodiment of the electrical connector assembly of the present invention.
Figure 16:
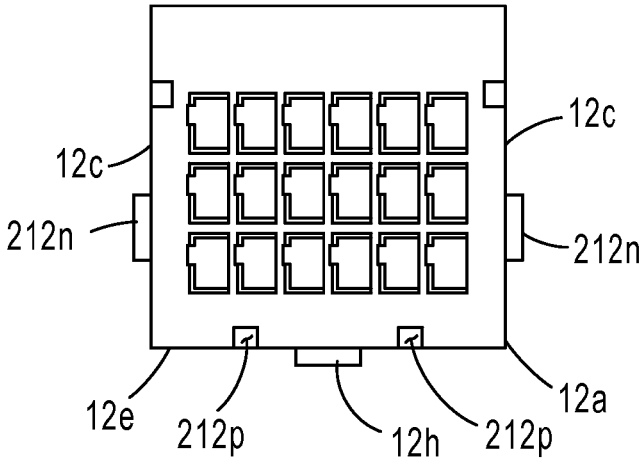
FIG. 16 is a front elevational view of the electrical connector housing of the second exemplary embodiment of the electrical connector assembly of the present invention.
Figure 17:
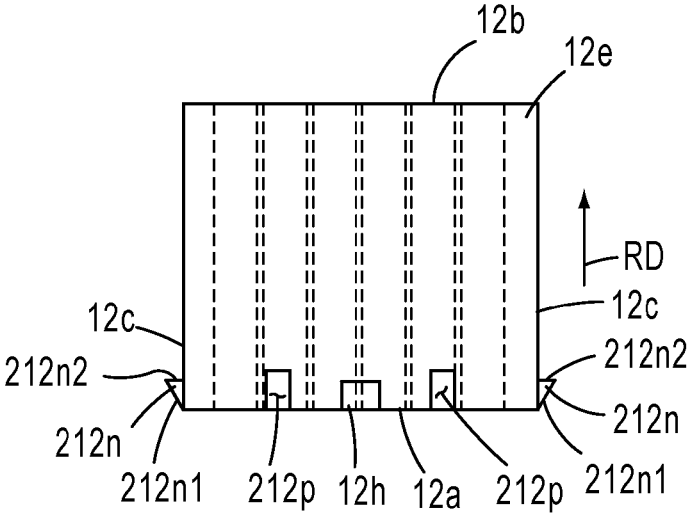
FIG. 17 is a bottom plan view of the electrical connector housing of the second exemplary embodiment of the electrical connector assembly of the present invention.
Figure 18:
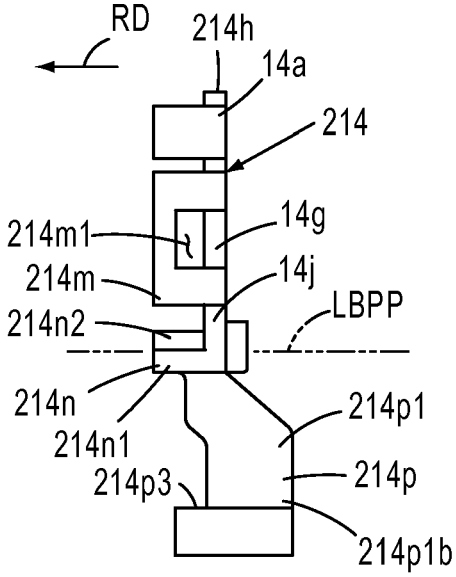
FIG. 18 is a side elevational view of the wire routing cover of the second exemplary embodiment of the electrical connector assembly of the present invention.
Figure 19:
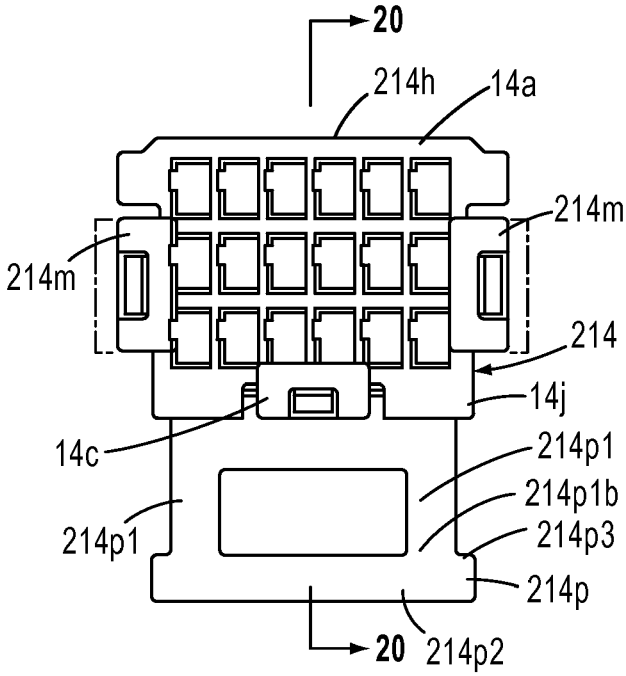
FIG. 19 is a front elevational view of the wire routing cover of the second exemplary embodiment of the electrical connector assembly of the present invention.
Figure 20:
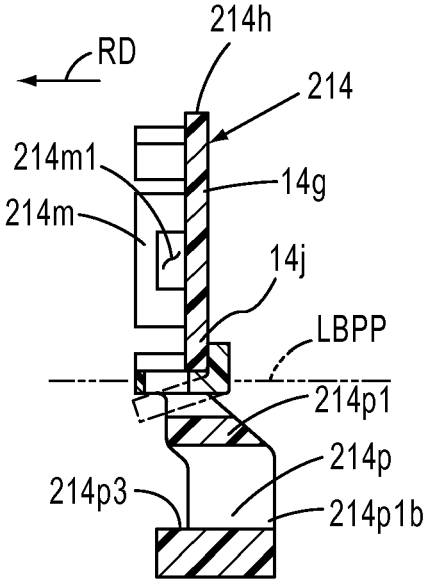
FIG. 20 is a cross-section view of the wire routing cover of the second exemplary embodiment of the electrical connector assembly of the present invention taken along line 20-20 in FIG. 19.
Figure 21:
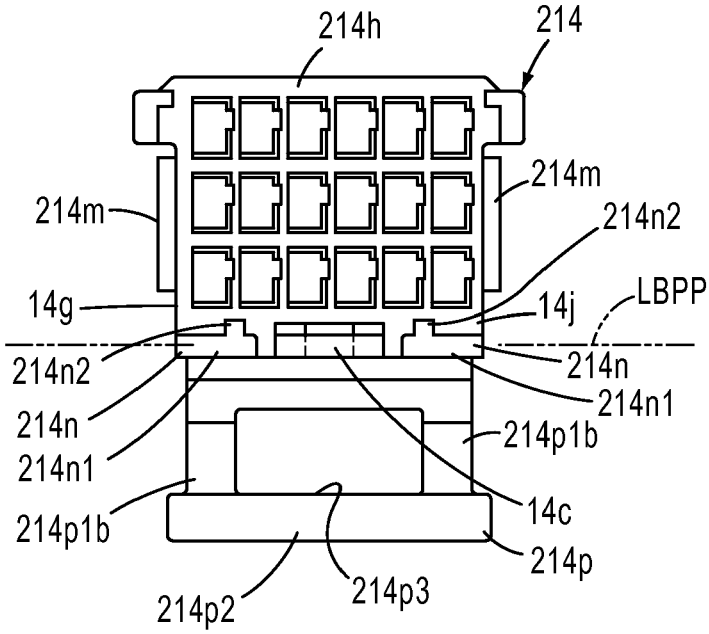
FIG. 21 is a rear elevational view of the wire routing cover of the second exemplary embodiment of the electrical connector assembly of the present invention.

As best shown in FIGS. 1, 16 and 17, the housing body 212 includes a pair of rib-receiving channels 212*p*. Each one of the pair of rib-receiving channels 212*p* is formed into the lower surface 12*e*. Respective ones of the pair of rib-receiving channels 212*p* are disposed apart from one another. The lower surface latch projection 12*h* that projects from the lower surface 12*e* is disposed between respective ones of the pair of rib-receiving channels 212*p* as illustrated in FIGS. 12, 16 and 17. With reference to FIGS. 12 and 15, each one of the pair of rib-receiving channels 212*p* commences from the front surface 12*a* and extends rectilinearly towards the rear surface 12*b*. As shown in FIGS. 16 and 17, the pair of rib-receiving channels 212*p* extend parallel to one another. Furthermore, note that lower surface latch projection 12*h* is disposed centrally relative to the pair of side surfaces 12*c*.

In FIGS. 12-14 and 18-23, the wire routing cover 214 includes a pair of side base panel latch elements 214*m*. Respective ones of the pair of side base panel latch elements 214*m* are connected in a cantilevered manner to respective ones of the pair of base panel side walls 14*g* and extend perpendicularly therefrom. Each one of the side base panel latch elements 214*m* has a side base panel latch hole 214*m*1 that is formed therethrough. As is known in the art, each one of the side base panel latch elements 214*m* is operative to angularly move to and between a normal state (solid lines in FIGS. 14 and 19) and a flexed state (dashed lines in FIGS. 14 and 19). Each one of the side base panel latch elements 214*m* are biased to the normal state.

Figure 13:
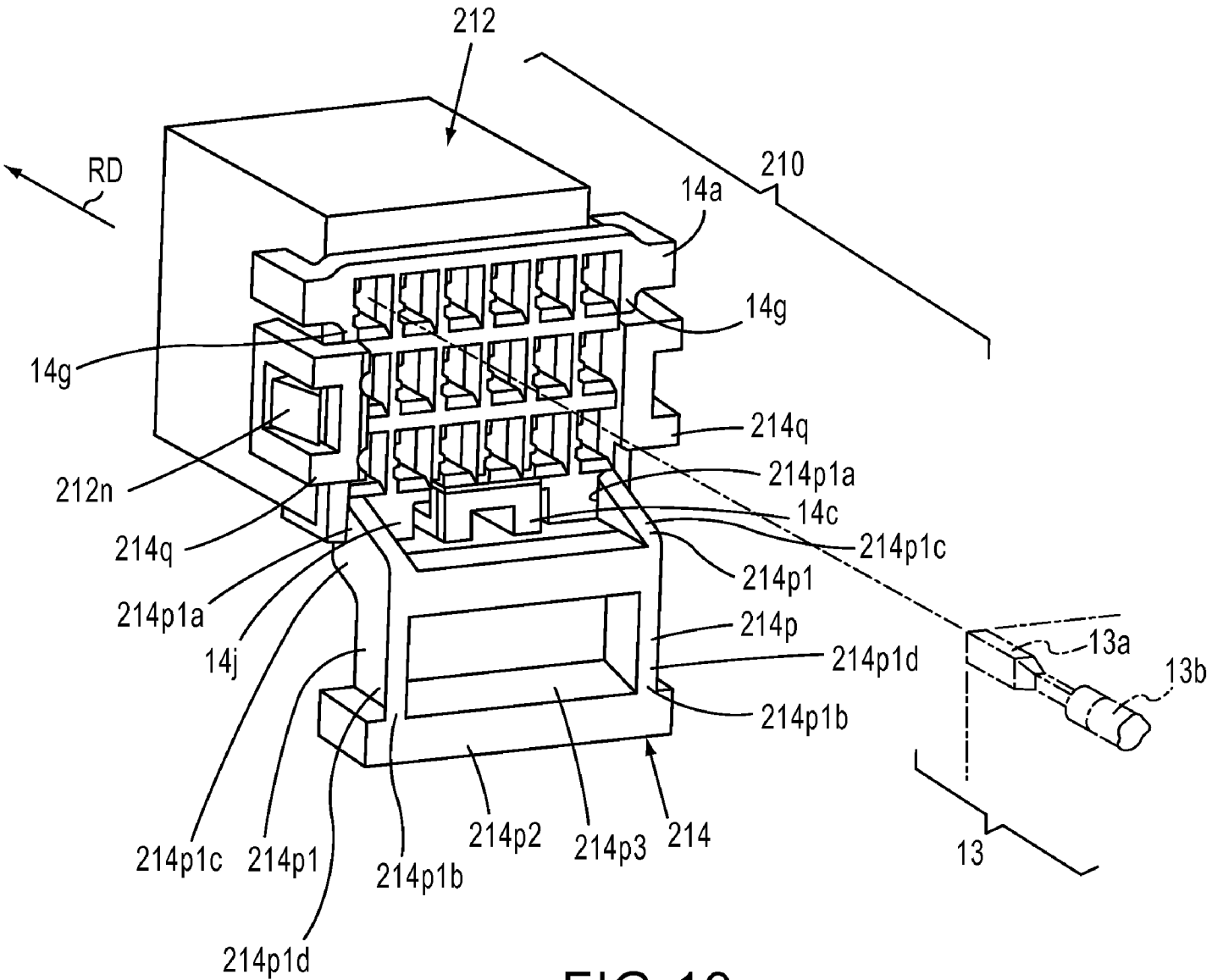
FIG. 13 is perspective view of the second exemplary embodiment of the electrical connector assembly of the present invention that includes the electrical connector housing and the wire routing cover releasably connected to one another.
Figure 14:
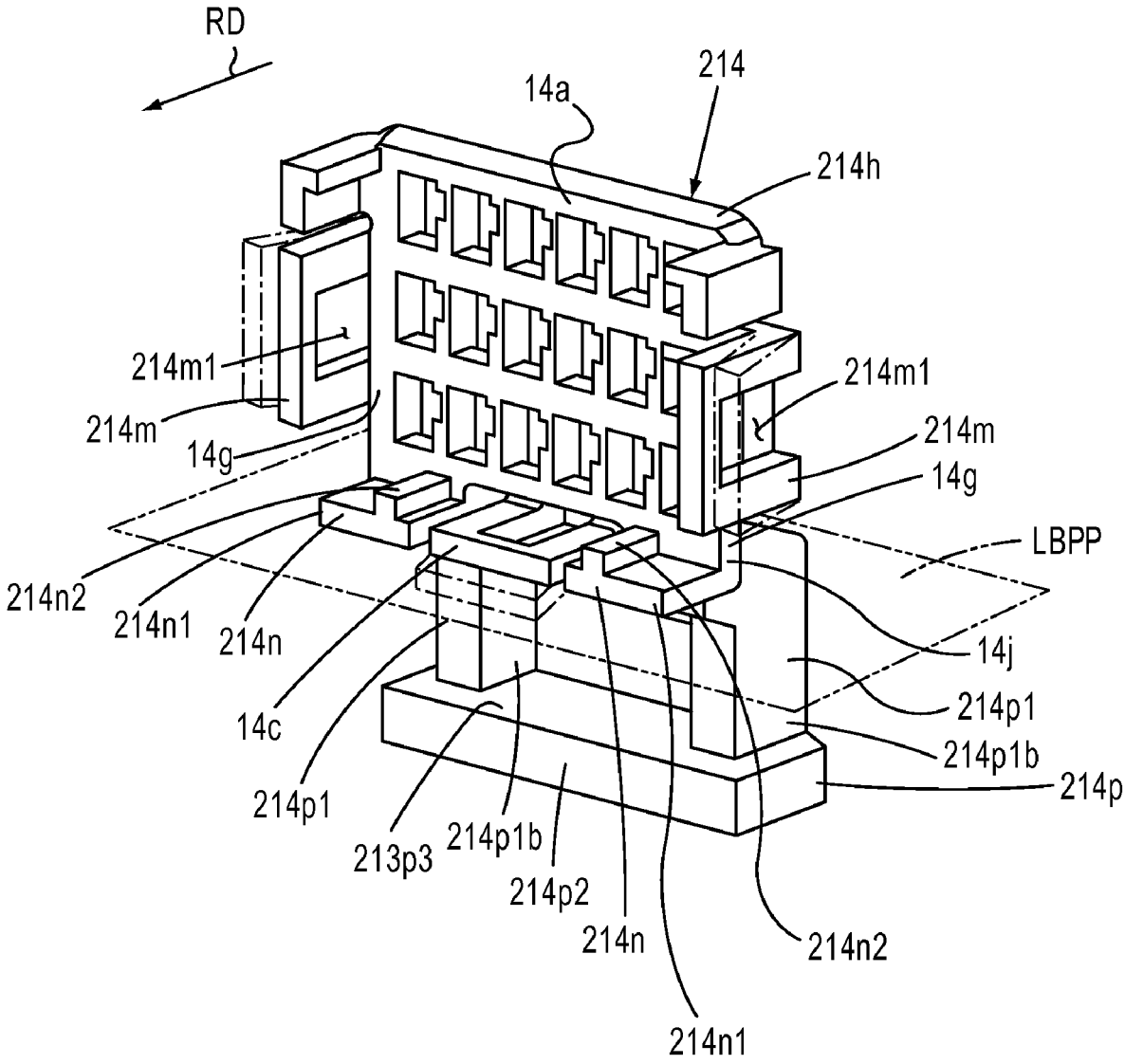
FIG. 14 is a rear perspective view of the wire routing cover of the second exemplary embodiment of the electrical connector assembly of the present invention

In FIGS. 12-14 and 18-23, the base panel 14*a* includes a pair of rib members 214*n*. The pair of rib members 214*n* are connected to the base panel lower wall 14*j* and extend rearwardly therefrom in the rearward direction RD. The pair of rib members 214*n* are disposed apart from one another with the lower base panel latch element 14*c* which is positioned between the pair of rib members 214*n*. Furthermore, as best shown in FIG. 14, each one of the pair of rib members 214*n* includes a flat plate portion 214*n*1 and a rib portion 214*n*2. The rib portion 214*n*2 is integrally formed with the flat plate portion 214*n*1 and projects perpendicularly from the flat plate portion 214*n*1 towards the base panel upper wall 14*h*. As shown in FIGS. 14, 18, 20 and 21, the pair of rib members 214*n* are disposed in a common lower base panel plane LBPP with the lower base panel latch element 14*c*.

Additionally, the wire routing cover 214 includes a wire retention structure 214*p* that is connected to and depends from the base panel lower wall 14*j*. The wire retention structure 214*p* includes a pair of spaced-apart legs 214*p*1 and a first cross-member 214*p*2. In FIGS. 12 and 13, each leg 214*p*1 has a connected leg end portion 214*p*1*a* integrally connected to the base panel lower wall 14*j* and an opposite free leg end portion 214*p*1*b*. As best shown in FIGS. 12 and 13, the first cross-member 214*p*2 is integrally connected to and extends between the free leg end portions 214*p*1*b*. Each one of the legs 214*p*1 includes an angled leg portion 214*p*1*c* and a straight leg portion 214*p*1*d* integrally connected to the angled leg portion 214*p*1*c*. Respective ones of the angled leg portions 214*p*1*c* is integrally connected to respective ones of the connected leg end portion 214*p*1*a* and project angularly away and downwardly from the base panel lower wall 14*j*. Respective ones of the straight leg portions 214*p*1*d* depend from respective ones of the angled leg portion 214*p*1*c* and extend generally parallel with the pair of base panel side walls 14*g*. Respective ones of the straight leg portions 214*p*1*d* are integrally connected to respective ones the free leg end portion 214*p*1*b*. Further, as shown in FIGS. 12-13 and 18-21, the wire retention structure 214*p* includes a flange 214*p*3 that is connected to and extends outwardly of the free leg end portions 214*p*1*b* and a rearward side of the cross-member 214*p*2.

Figure 22:
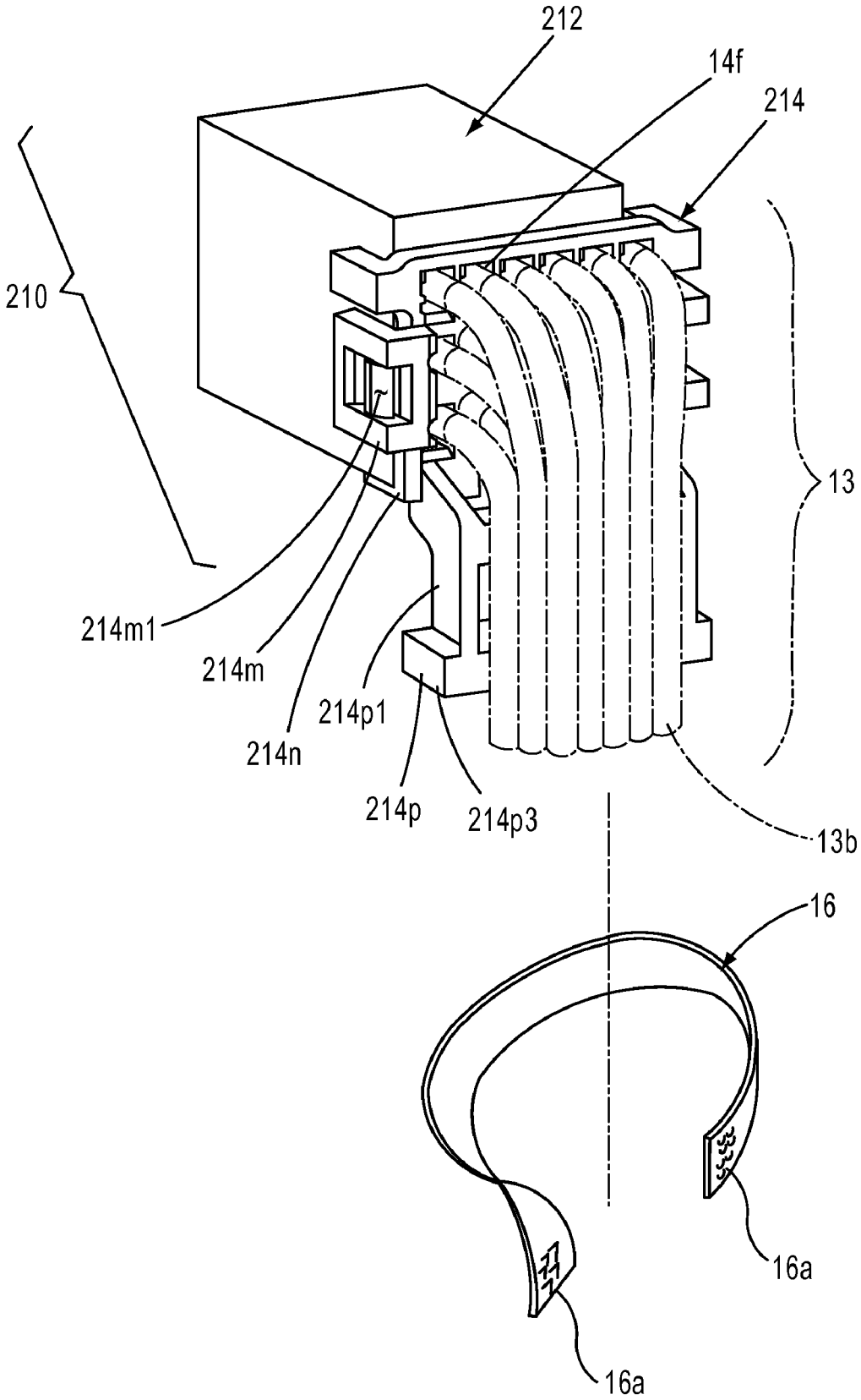
FIG. 22 is perspective view of the second exemplary embodiment of the electrical connector assembly of the present invention that includes the electrical connector housing and the wire routing cover releasably connected to one another and the wire structure connected thereto with a cable tie disposed apart therefrom.
Figure 23:
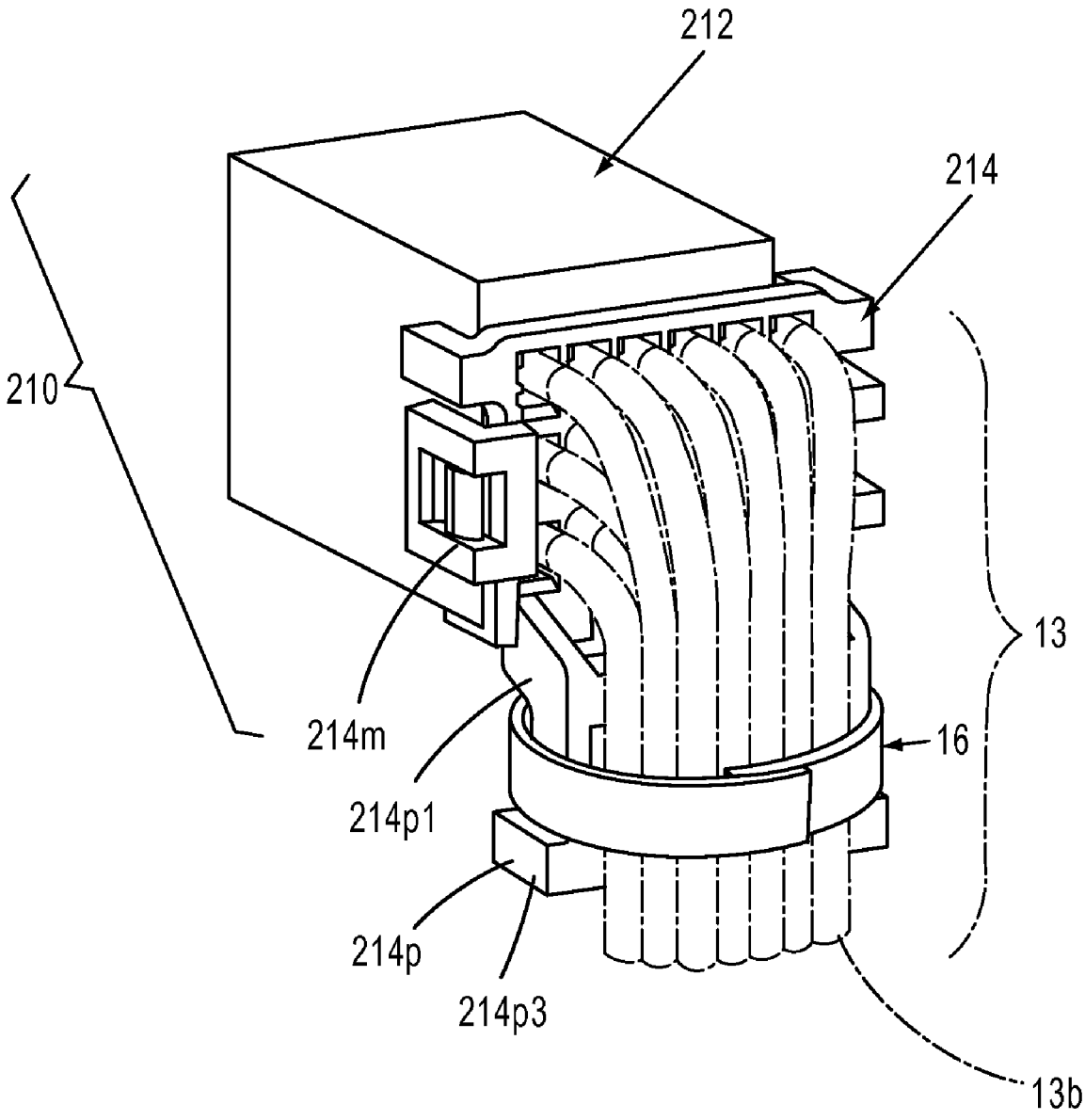
FIG. 23 is perspective view of the second exemplary embodiment of the electrical connector assembly of the present invention that includes the electrical connector housing and the wire routing cover releasably connected to one another with the cable tie securing the wire structure to the wire routing cover.

In FIG. 22, the wire structure 13 is connected to the electrical connector assembly 210 in which the wire routing cover 214 is releasably connected to the housing body 212. In this manner, as is known in the art, the terminals 13*a* extend through the wire routing holes 14*f* of the wire routing cover 214 and into the terminal receiving holes 12*f* of the housing body 212. Note in FIGS. 22 and 23 that the wires 13*b* depend from the electrical connector assembly 210 in a bundle that extends generally parallel with the wire retention structure 214*p*. If desired, a cable tie 16 can be used to secure the bundle of wires to the wire retention structure 214*p*. By way of example only and not by way of limitation, the cable tie 16 is a strap member fabricated from a pliable material such as plastic, fabric or rubber that has a fastener 16*a* connected at opposing free ends. Although any conventional fastener such as a clip, a snap, a buckle or the like can be used, the illustrated fastener 16*a* is a conventional hook and loop fastener. In FIG. 23, when secured to the wire routing cover 214, the cable tie 16 wraps around the wires 13*b* and the each leg 214*p*1 and the flange 214*p*3 prevents the cable tie 16 from slipping off the wrapped buddle of wires 13*b*.

Figure 24:
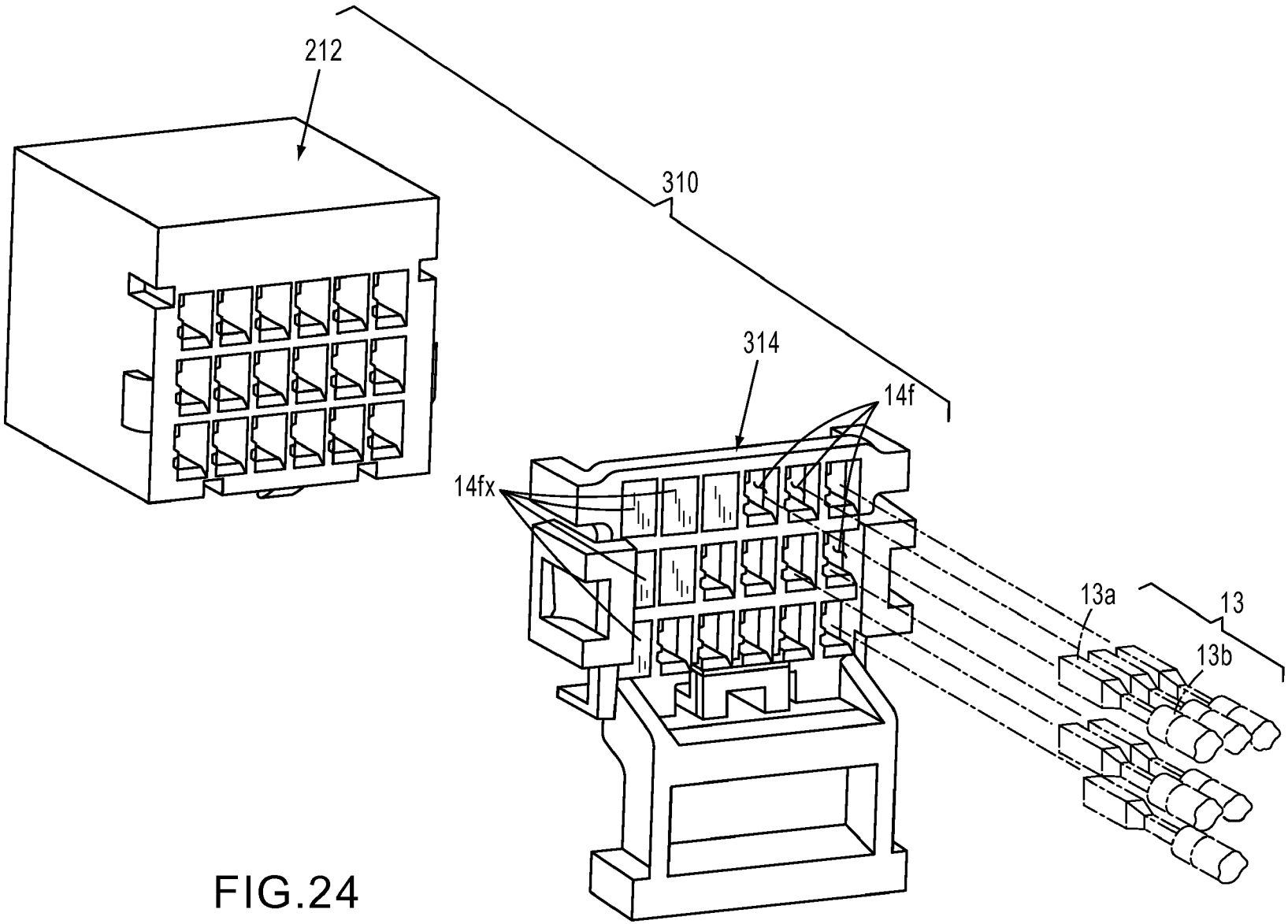
FIG. 24 is an exploded perspective view of a third exemplary embodiment of the electrical connector assembly of the present invention that includes the electrical connector housing and the wire routing cover disconnected from one another with the wiring routing cover having several flashed-over wire routing holes.
Figure 25:
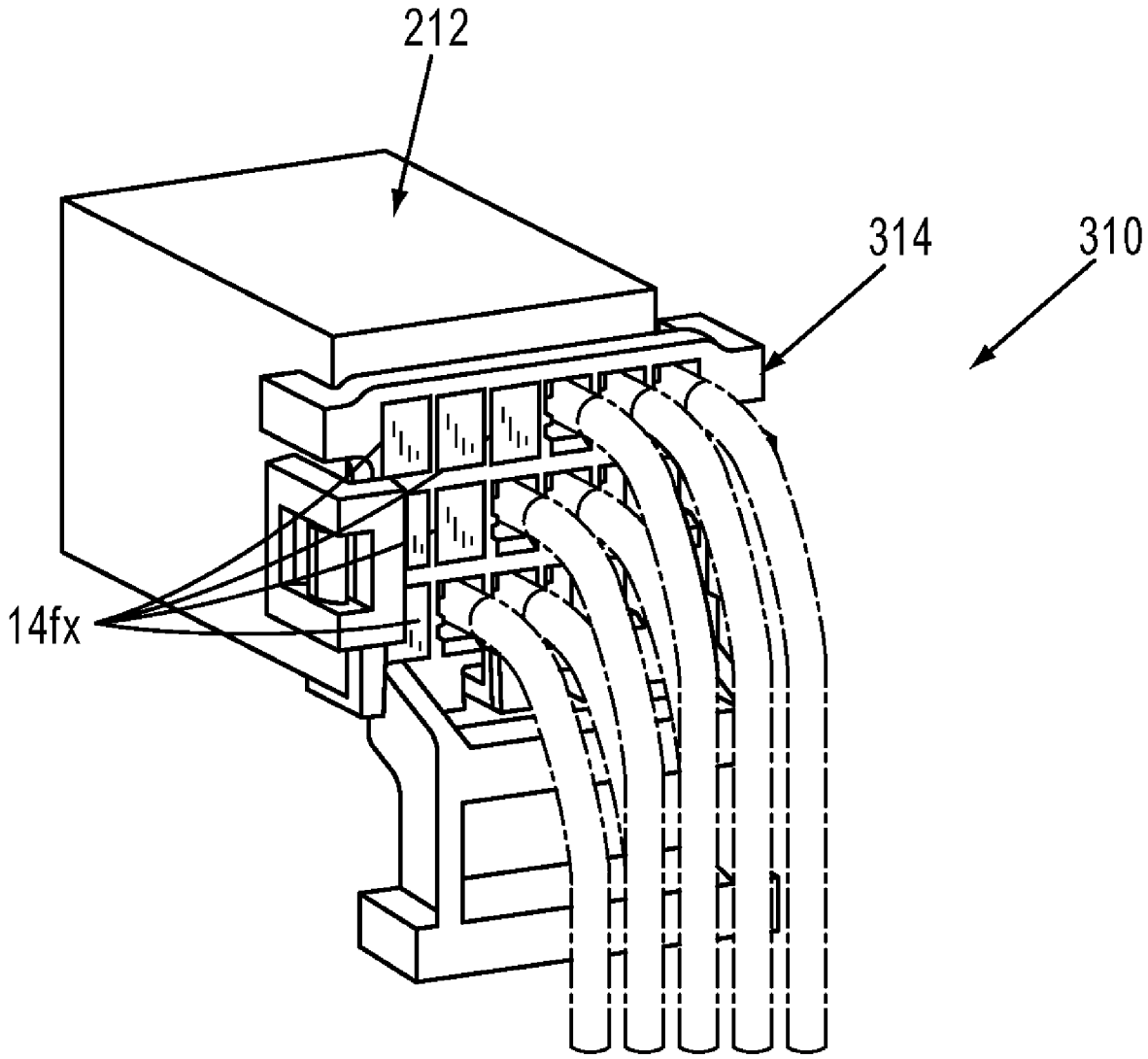
FIG. 25 is perspective view of the third exemplary embodiment of the electrical connector assembly of the present invention shown in FIG. 24 with the electrical connector housing and the flashed-over wire routing cover releasably connected to the one another and with the wire structure connected thereto.

Upon connecting the housing body 212 and the wire routing cover 214 together as shown in sequence from FIG. 12 to FIG. 13, respective ones of the pair of rail-receiving channels 12*g* are aligned to slidably receive respective ones of the pair of rails 14*b*2 and the lower surface latch projection 12*h* is aligned to releasably capture the lower base panel latch element 14*c*. The lower base panel latch hole 14*k* is sized to releasably capture the lower surface latch projection 12*h* and each one of the side base panel latch holes 14*k* is sized to releasably capture respective ones of the pair of side latch projections 212*n*. Further, each one of the pair of rib-receiving channels 212*p* is sized to slidably receive respective ones of the pair of rib portions xxx A third exemplary embodiment of an electrical connector assembly 310 of the present invention is illustrated in FIGS. 24 and 25. The third exemplary embodiment of the electrical connector assembly 310 is similar to the second exemplary embodiment of the electrical connector assembly 210. This difference is explained hereinbelow.

A wire routing cover 314 is similar to the wire routing cover 214 except that several of the wire routing holes 14*f* are covered, blocked, plugged or otherwise flashed over as represented by 14*fx*. In this way, if a user desires less than the number of wire routing holes 14*f* as provided, the user could cover, block, plug or other flash-over those wire routing holes 14*f* that are not needed. By covering, blocking, plugging or flashing-over the unnecessary wire routing holes, a whistling noise, that might otherwise occur, can be suppressed.

Figure 26:
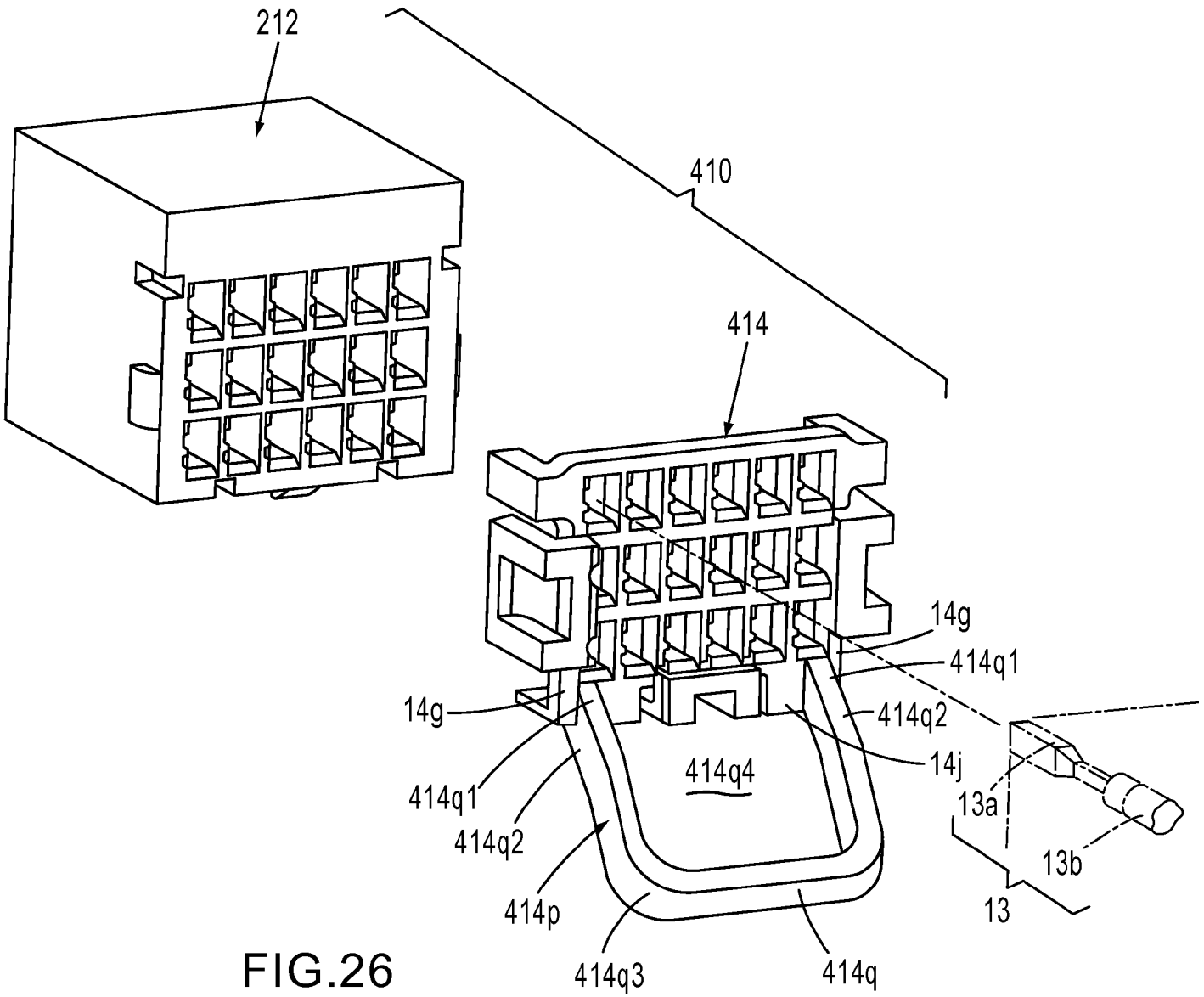
FIG. 26 is an exploded perspective view of a fourth exemplary embodiment of the electrical connector assembly of the present invention that includes the electrical connector housing and a modified wire routing cover disconnected from one another.
Figure 27:
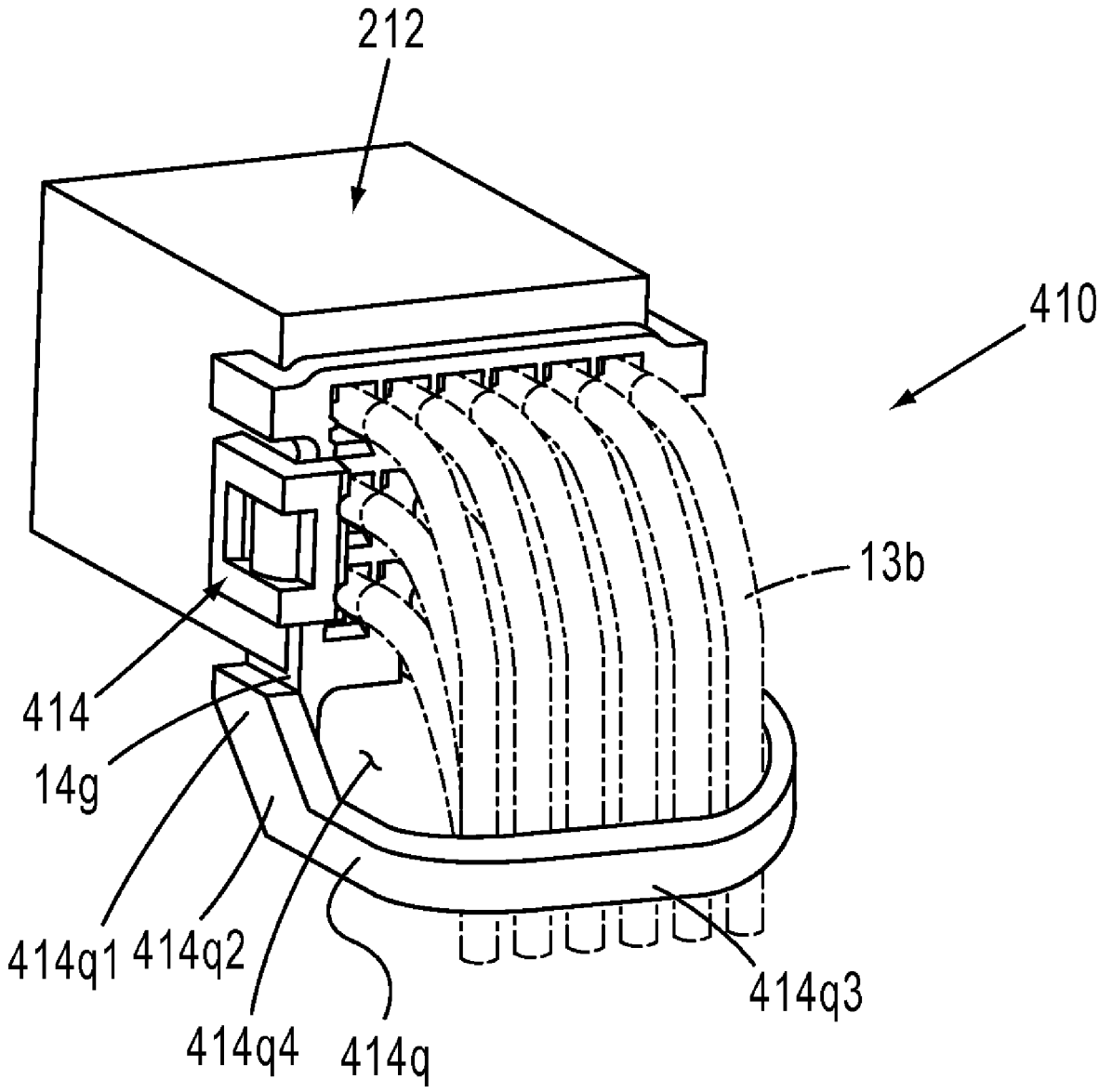
FIG. 27 is perspective view of the fourth exemplary embodiment of the electrical connector assembly of the present invention shown in FIG. 26 with the electrical connector housing and the wire routing cover releasably connected to the one another and with the wire structure connected thereto.

A fourth exemplary embodiment of an electrical connector assembly 410 of the present invention is illustrated in FIGS. 26 and 27. The fourth exemplary embodiment of the electrical connector assembly 310 is similar to the second exemplary embodiment of the electrical connector assembly 210. This difference is discussed below.

A wire retention structure 414*p* of a wire routing cover 414 includes a band member 414*q*. The band member 414*q* has a pair of connected band end portions 414*q*1 that are integrally connected to the base panel lower wall 14*j* and forms a wire passageway 414*q*4 with the base panel lower wall 14*j*. Respective ones of the connected band end portions are connected to the base panel lower wall 14*j* adjacent respective ones of the pair of base panel side walls 14*g*. By way of example only and not by way of limitation, the band member 414*q* has a pair of angled band member portions 414*q*2 and an inverted C-shaped bridge portion 414*q*3. Respective ones of the pair of angled band members 414*q*2 interconnect the inverted C-shaped bridge portion 414*q*3 and the base panel lower wall 14*g*. In FIG. 27, the wire passageway 414*q*4 is sized to receive the bundle of wires 13*b* in order to retain the bundle of wires 13*b* in place without use of the cable tie 16.

Figure 28:
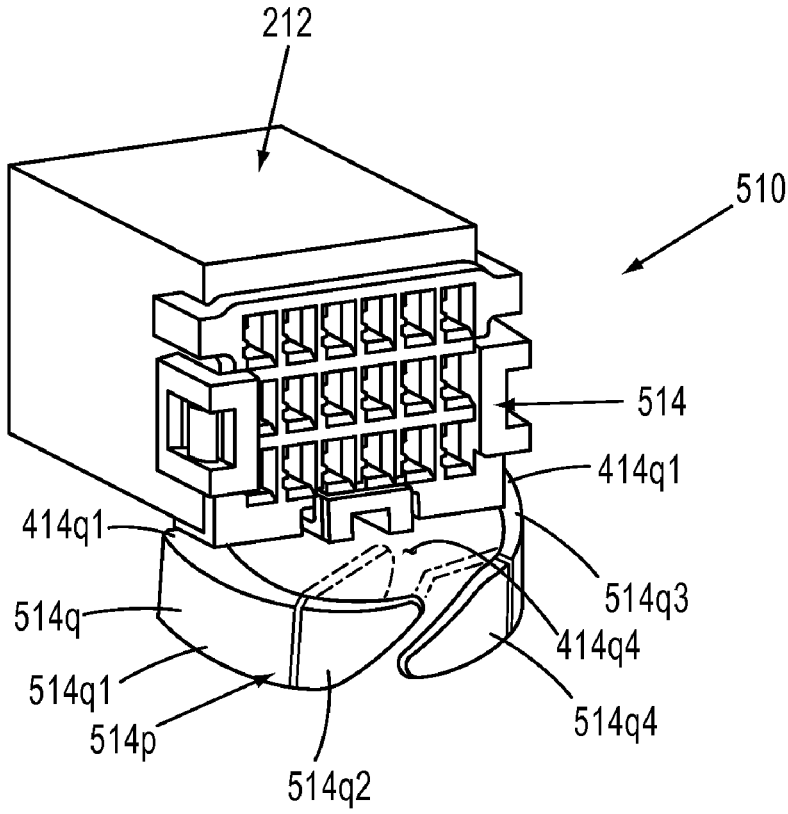
FIG. 28 is an exploded perspective view of a fifth exemplary embodiment of the electrical connector assembly of the present invention that includes the electrical connector housing and another modified wire routing cover disconnected from one another.
Figure 29:
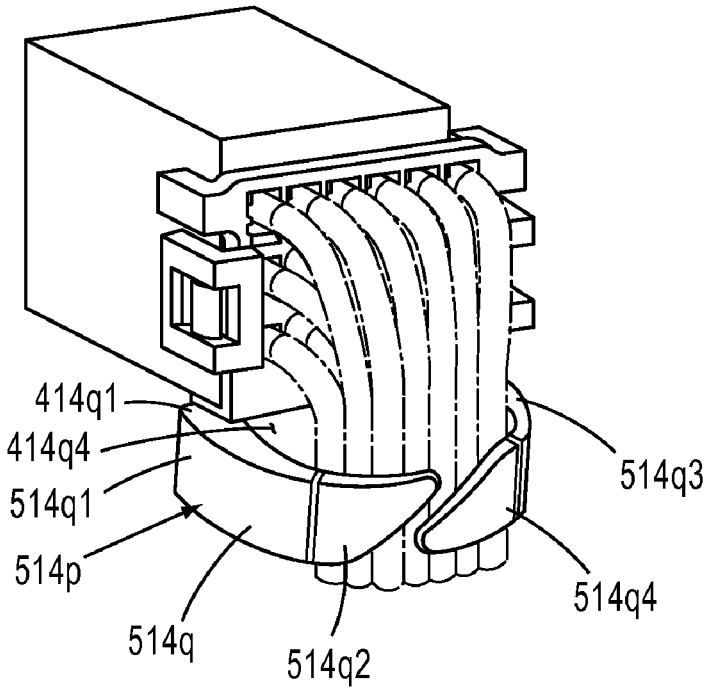
FIG. 29 is perspective view of the fifth exemplary embodiment of the electrical connector assembly of the present invention shown in FIG. 28 with the electrical connector housing and the wire routing cover releasably connected to the one another and with the wire structure connected thereto.

A fifth exemplary embodiment of an electrical connector assembly 510 of the present invention is illustrated in FIGS. 28 and 29. The fifth exemplary embodiment of the electrical connector assembly 510 is similar to the fourth exemplary embodiment of the electrical connector assembly 410. This difference is discussed below.

In FIGS. 28 and 29, a wire retention structure 514*p* of a wire routing cover 514 includes a band member 514*q*. The band member 514*q* has a first band member segment 514*q*1, a first gate element 514*q*2, a second band member segment 514*q*3 and a second gate element 514*q*4. The first band member segment 514*q*1 interconnects one of the connected band end portions 414*q*1 and the first gate element 514*q*2, the second band member segment 514*q*3 interconnects a remaining one of the connected band end portions 414*q*1 and the second gate element 514*q*4 such that the first gate element 514*q*2 and second gate element 514*q*4 are disposed adjacent one another (solid lines in FIGS. 28 and 29). The first gate element 514*q*2 is hingeably connected to the first band member segment 514*q*1 and is operative to move to and between a first gate closed position (solid line in FIG. 28) and a first gate opened position (dashed line in FIG. 28). In the first gate closed position, the first gate element 514*q*2 blocks entry into the wire passageway 414*q*4. In the first gate opened position, the first gate element 514*q*2 permits entry into the wire passageway 414*q*4. The second gate element is hingeably connected to the second band member segment 514*q*3 and is operative to move to and between a second gate closed position (solid line in FIG. 28) and a second gate opened position (dashed line in FIG. 28). In the second gate closed position, the second gate element 514*q*4 blocks entry into the wire passageway 414*q*4. In the second gate opened position (dashed line in FIG. 28), the second gate element 514*q*4 permits entry into the wire passageway 414*q*4. Using the first and second gate elements 514*q*2 and 514*q*3, the wires 13*b* can be inserted into and retained in the wire passageway 414*q*4 as reflected in FIG. 29.

One of ordinary skill in the art would appreciate that the present invention can be implemented with or without the wire routing cover which is detachable from the electrical connector housing. Thus, cost and packaging size can be reduced.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector housing, comprising:

a housing body having a generally box-shaped configuration with a front surface, a rear surface disposed opposite the front surface, a pair of opposing side surfaces connected to and between the front and rear surfaces, an upper surface and a lower surface disposed opposite the upper surface and connected to and between the front and rear surfaces and to and between the pair of side surfaces, the housing body having a plurality of terminal-receiving holes formed through the housing body to and between the front surface and the rear surface, a pair of rail-receiving channels with a respective one of the pair of rail-receiving channels formed into a respective one of the pair of side surfaces and at least one latch projection connected to and projecting from at least one of the pair of side surfaces and the lower surface, wherein the at least one latch projection includes a lower surface latch projection projecting from the lower surface, wherein the lower surface latch projection commences at the front surface and extends towards the rear surface and wherein the lower surface latch projection is configured, in cross-section, as a right triangle and forms a lower latch ramping surface commencing at the front surface and projecting away from the lower surface as the lower latch ramping surface extends towards the rear surface.

2. An electrical connector housing according to claim 1, wherein each one of the pair of rail-receiving channels commences from the front surface and extends rectilinearly towards the rear surface.

3. An electrical connector housing according to claim 2, wherein the pair of rail-receiving channels extend parallel to one another and are disposed in a common rail channel plane.

4. An electrical connector housing according to claim 1, wherein the at least one latch projection includes a lower surface latch projection projecting from the lower surface.

5. An electrical connector housing according to claim 4, wherein the lower surface latch projection commences at the front surface and extends towards the rear surface.

6. An electrical connector housing according to claim 1, wherein the at least one latch projection includes a pair of side latch projections, a respective one of the pair of side latch projections projecting from a respective one of the pair of sided surfaces.

7. An electrical connector housing according to claim 1, wherein the plurality of terminal-receiving holes form a matrix of terminal-receiving holes arranged in a plurality of rows and in a plurality of columns.

8. An electrical connector housing according to claim 7, wherein at least one of the plurality of rows and the plurality of columns of the matrix of terminal-receiving holes extends parallel to one another.

9. An electrical connector housing, comprising:

a housing body having a generally box-shaped configuration with a front surface, a rear surface disposed opposite the front surface, a pair of opposing side surfaces connected to and between the front and rear surfaces, an upper surface and a lower surface disposed opposite the upper surface and connected to and between the front and rear surfaces and to and between the pair of side surfaces, the housing body having a plurality of terminal-receiving holes formed through the housing body to and between the front surface and the rear surface, a pair of rail-receiving channels with a respective one of the pair of rail-receiving channels formed into a respective one of the pair of side surfaces and at least one latch projection connected to and projecting from at least one of the pair of side surfaces and the lower surface, wherein the at least one latch projection includes a pair of side latch projections, a respective one of the pair of side latch projections projecting from a respective one of the pair of sided surfaces and wherein each one of the pair of side latch projections commences at the front surface and extends towards the rear surface.

10. An electrical connector housing according to claim 9, wherein each one of the pair of side latch projections is configured, in cross-section, as a right triangle and forms a side latch ramping surface commencing at the front surface and projecting away from the respective side surface as the side latch ramping surface extends towards the rear surface.

11. An electrical connector housing according to claim 9, further comprising a pair of side surface latch projections, a respective one of the pair of side surface latch projections commences at the front surface and extends towards the rear surface.

12. An electrical connector housing, comprising:

a housing body having a generally box-shaped configuration with a front surface, a rear surface disposed opposite the front surface, a pair of opposing side surfaces connected to and between the front and rear surfaces, an upper surface and a lower surface disposed opposite the upper surface and connected to and between the front and rear surfaces and to and between the pair of side surfaces, the housing body having a plurality of terminal-receiving holes formed through the housing body to and between the front surface and the rear surface, a pair of rail-receiving channels with a respective one of the pair of rail-receiving channels formed into a respective one of the pair of side surfaces and at least one latch projection connected to and projecting from at least one of the pair of side surfaces and the lower surface; and a pair of side surface latch projections, a respective one of the pair of side surface latch projections commences at the front surface and extends towards the rear surface, wherein a respective one of the pair of side surface latch projections is configured, in cross-section, as a right triangle and forms a side latch ramping surface commencing at the front surface and projecting away from a respective one of the pair of side surfaces as the side latch ramping surface extends towards the rear surface.

13. An electrical connector housing, comprising:

a housing body having a generally box-shaped configuration with a front surface, a rear surface disposed opposite the front surface, a pair of opposing side surfaces connected to and between the front and rear surfaces, an upper surface and a lower surface disposed opposite the upper surface and connected to and between the front and rear surfaces and to and between the pair of side surfaces, the housing body having a plurality of terminal-receiving holes formed through the housing body to and between the front surface and the rear surface, a pair of rail-receiving channels with a respective one of the pair of rail-receiving channels formed into a respective one of the pair of side surfaces and at least one latch projection connected to and projecting from at least one of the pair of side surfaces and the lower surface, wherein the housing body includes a pair of rib-receiving channels, each one of the pair of rib-receiving channels is formed into the lower surface, respective ones of the pair of rib-receiving channels being disposed apart from one another with the at least one latch projection projecting from the lower surface and being disposed between respective ones of the pair of rib-receiving channels.

14. An electrical connector housing according to claim 13, wherein each one of the pair of rib-receiving channels commences from the front surface and extends rectilinearly towards the rear surface.

15. An electrical connector housing according to claim 14, wherein the pair of rib-receiving channels extend parallel to one another.

16. An electrical connector housing according to claim 14, wherein the at least one latch projection is disposed centrally relative to the pair of side surfaces.

17. A wire routing cover for an electrical connector, the wire routing cover comprising:

a base panel having a front base panel surface and an opposing rear base panel surface with a plurality of wire routing holes formed through the base panel between the front and rear base panel surfaces and having a pair of base panel side walls, a base panel upper wall and a base panel lower wall with the pair of base panel side walls interconnecting the base panel upper wall and the base panel lower wall to form a generally rectangular configuration surrounding the plurality of wire routing holes;

a pair of rail members extending parallel to one another, respective ones of the pair of rail members connected to respective ones of the pair of base panel side walls adjacent the base panel upper wall and extending perpendicularly therefrom in a rearwardly direction; and at least one latch element connected to the base panel and extending perpendicularly therefrom in a cantilevered manner and in the rearwardly direction.

18. A wire routing cover according to claim 17, wherein the at least one latch element includes a lower base panel latch element connected to the base panel lower wall and disposed centrally and between the pair of base panel side walls, the lower base panel latch element having a lower base panel latch hole formed therethrough and operative to angularly move to and between a normal state and a flexed state, the lower base panel latch element biased to the normal state.

19. A wire routing cover according to claim 18, wherein the at least one latch element includes a pair of side base panel latch elements, respective ones of the pair of side base panel latch elements connected to respective ones of the pair of base panel side walls, each one of the side base panel latch elements having a side base panel latch hole formed therethrough and operative to angularly move to and between a normal state and a flexed state, each one of the side base panel latch elements being biased to the normal state.

20. A wire routing cover according to claim 18, wherein the base panel includes a pair of rib members connected to the base panel lower wall and extending rearwardly therefrom, the pair of rib members disposed apart from one another with the lower base panel latch element positioned between the pair of rib members.

21. A wire routing cover according to claim 20, wherein each one of the pair of rib members includes a flat plate portion disposed in a common lower base panel plane with the lower base panel latch element and a rib portion integrally formed with the flat plate portion and projecting perpendicularly therefrom towards the base panel upper wall.

22. A wire routing cover according to claim 17, wherein each one of the pair of rail members includes a side rail wall and a rail integrally formed with the side rail wall to form a right angle, respective ones of the side rail walls extending adjacent the base panel upper wall toward the base panel lower wall, respective ones of the rails extending from a respective base panel side wall towards a respective other base panel side wall.

23. A wire routing cover according to claim 22, wherein the base panel side walls are disposed between respective ones of the side rail walls and respective ones of the rails being integrally connected to the rear base panel surface.

24. A wire routing cover according to claim 17, wherein the at least one latch element includes a pair of side base panel latch elements, respective ones of the pair of side base panel latch elements connected to respective ones of the pair of base panel side walls, each one of the side base panel latch elements having a side base panel latch hole formed therethrough and operative to angularly move to and between a normal state and a flexed state, the lower base panel latch element biased to the normal state.

25. A wire routing cover according to claim 17, further comprising a wire retention structure connected to and depending from the base panel lower wall.

26. A wire routing cover according to claim 25, wherein the wire retention structure includes a pair of spaced-apart legs and a first cross-member, each leg having a connected leg end portion integrally connected to the base panel lower wall and an opposite free leg end portion, the first cross-member integrally connected to and extending between the free leg end portion.

27. A wire routing cover according to claim 26, wherein each one of the legs includes an angled leg portion and a straight leg portion integrally connected to the angled leg portion, respective ones of the angled leg portion integrally connected to respective ones of the connected leg end portions and projecting angularly away and downwardly from respective ones of the base panel lower wall, respective ones of the straight leg portions depending from respective ones of the angled leg portions and extending generally parallel with the pair of base panel side walls, respective ones of the straight leg portions being integrally connected to respective ones of the free leg end portions.

28. A wire routing cover according to claim 26, wherein the wire retention structure includes a flange connected to and extending outwardly of the free leg end portions and a rearward side of the cross-member.

29. A wire routing cover according to claim 26, wherein the wire retention structure is a band member having a pair of connected band end portions integrally connected to the base panel lower wall and forming a wire passageway with the base panel lower wall, respective ones of the connected band end portions connected to the base panel lower wall adjacent respective ones of the pair of base panel side walls.

30. A wire routing cover according to claim 29, wherein the band member has a pair of angled band member portions and an inverted C-shaped bridge portion, respective ones of the pair of angled band member interconnecting the inverted C-shaped bridge portion and the base panel lower wall.

31. A wire routing cover according to claim 29, wherein the band member has a first band member segment, a first gate element, a second band member segment and a second gate element, the first band member segment interconnecting one of the connected band end portions and the first gate element, the second band member segment interconnecting a remaining one of the connected band end portions and the second gate element such that the first and second gate elements are disposed adjacent one another, the first gate element hingeably connected to the first band member segment and operative to move to and between a first gate closed position and a first gate opened position such that in the first gate closed position, the first gate element blocks entry into the wire passageway and, in the first gate opened position, the first gate element permits entry into the wire passageway, and the second gate element hingeably connected to the second band member segment and operative to move to and between a second gate closed position and a second gate opened position such that in the second gate closed position, the second gate element blocks entry into the wire passageway and, in the second gate opened position, the second gate element permits entry into the wire passageway.

32. An electrical connector assembly, comprising:

a housing body having a generally box-shaped configuration with a front surface, a rear surface disposed opposite the front surface, a pair of opposing side surfaces connected to and between the front and rear surfaces, an upper surface and a lower surface disposed opposite the upper surface and connected to and between the front and rear surfaces and to and between the pair of side surfaces, the housing body having a plurality of terminal-receiving holes formed through the housing body to and between the front surface and the rear surface, a pair of rail-receiving channels with a respective one of the pair of rail-receiving channels formed into a respective one of the pair of side surfaces and at least one latch projection connected to and projecting from at least one of the pair of side surfaces and the lower surface; and a wire routing cover including:

a base panel having a front base panel surface and an opposing rear base panel surface with a plurality of wire routing holes formed through the base panel between the front and rear base panel surfaces and having a pair of base panel side walls, a base panel upper wall and a base panel lower wall with the pair of base panel side walls interconnecting the base panel upper wall and the base panel lower wall to form a generally rectangular configuration surrounding the plurality of wire routing holes;

a pair of rail members extending parallel to one another, respective ones of the pair of rail members connected to respective ones of the pair of base panel side walls adjacent the base panel upper wall and extending perpendicularly therefrom in a rearwardly direction; and at least one latch element connected to the base panel and extending perpendicularly therefrom in a cantilevered manner and in the rearwardly direction, wherein, upon connecting the housing body and the wire routing cover together, respective ones of the pair of rail-receiving channels slidably receive at least a portion of respective ones of the pair of rail members and the at least one latch projection is releasably captured by the at least one latch element.

33. An electrical connector assembly according to claim 32, wherein the at least one latch projection includes a lower surface latch projection projecting from the lower surface and a pair of side latch projections, a respective one of the pair of side latch projections projecting from a respective one of the pair of sided surfaces and wherein at least one latch element includes a lower base panel latch element and a pair of side base panel latch elements, the lower base panel latch element connected to the base panel lower wall and disposed centrally and between the pair of base panel side walls, the lower base panel latch element having a lower base panel latch hole formed therethrough and sized to releasably capture the lower surface latch projection, the lower base panel latch element operative to angularly move to and between a normal state and a flexed state and, the lower base panel latch element biased to the normal state, respective ones of the pair of side base panel latch elements connected to respective ones of the pair of base panel side walls, each one of the side base panel latch elements having a side base panel latch hole formed therethrough and sized to releasably capture respective ones of the pair of side latch projections, each one of the side base panel latch elements operative to angularly move to and between a normal state and a flexed state, the lower base panel latch element biased to the normal state.

34. An electrical connector assembly according to claim 33, wherein the base panel includes a pair of rib members connected to the base panel lower wall and extending rearwardly therefrom, the pair of rib members disposed apart from one another with the lower base panel latch element positioned between the pair of rib members, each one of the pair of rib members includes a flat plate portion disposed in a common lower base panel plane with the lower base panel latch element and a rib portion integrally formed with the flat plate portion and projecting perpendicularly therefrom towards the base panel upper wall and wherein the housing body includes a pair of rib-receiving channels sized to slidably receive respective ones of the pair of rib portions, each one of the pair of rib-receiving channels is formed into the lower surface, respective ones of the pair of rib-receiving channels being disposed apart from one another with the at least one latch projection projecting from the lower surface and being disposed between respective ones of the pair of rib-receiving channels.

35. An electrical connector assembly according to claim 34, wherein the base panel includes a wire retention structure connected to and depending from the base panel lower wall.

* * * * *